US010031450B2

(12) United States Patent
Sakaguchi et al.

(10) Patent No.: US 10,031,450 B2
(45) Date of Patent: Jul. 24, 2018

(54) IMAGE FORMING APPARATUS

(71) Applicant: CANON KABUSHIKI KAISHA, Tokyo (JP)

(72) Inventors: Ryou Sakaguchi, Toride (JP); Hiroshi Matsumoto, Toride (JP); Shinnosuke Iwadate, Toride (JP); Teruhito Kai, Kashiwa (JP); Hiroto Nishihara, Tsukuba (JP); Hiromi Shimura, Toride (JP); Keita Takahashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/467,114

(22) Filed: Mar. 23, 2017

(65) Prior Publication Data

US 2017/0277087 A1 Sep. 28, 2017

(30) Foreign Application Priority Data

Mar. 28, 2016 (JP) ..... 2016-064112

(51) Int. Cl.
*G03G 15/20* (2006.01)

(52) U.S. Cl.
CPC ..... *G03G 15/2039* (2013.01)

(58) Field of Classification Search
CPC ..... G03G 15/01; G03G 15/22; G03G 15/161; G03G 15/0178; G03G 15/0189; G03G 15/1615; G03G 15/2039; G03G 2215/0103; G03G 2215/00139; G03G 2215/2074; G03G 2221/1603
See application file for complete search history.

(56) References Cited

U.S. PATENT DOCUMENTS

| | | | | |
|---|---|---|---|---|
| 5,107,279 | A | 4/1992 | Yamamoto et al. | |
| 8,620,193 | B2 | 12/2013 | Yamamoto et al. | |
| 9,324,010 | B2 | 4/2016 | Iwadate et al. | |
| 2014/0153943 | A1* | 6/2014 | Miyadera ..... | G03G 15/5062 399/49 |

(Continued)

FOREIGN PATENT DOCUMENTS

| | | | |
|---|---|---|---|
| JP | 2004118218 A | * | 4/2004 |
| JP | 2005249971 A | * | 9/2005 |
| JP | 2016-020993 A | | 2/2016 |

*Primary Examiner* — Thomas Giampaolo, II
(74) *Attorney, Agent, or Firm* — Fitzpatrick, Cella, Harper & Scinto

(57) ABSTRACT

An image forming apparatus includes: an image forming unit configured to perform image formation in a first mode, in which image formation is performed by a plurality of image forming stations, or a second mode, in which image formation is performed by a predetermined image forming station among the plurality of image forming stations; and a controller configured to: control the image forming unit to perform a preparation operation in accordance with color mode information; set a restricted operation state in which the controller prohibits the image formation in the first mode and permits the image formation in the second mode when any one image forming station, except for the predetermined image forming station, is incapable of performing image formation; and prevent the image forming unit from performing the preparation operation when the first mode is set as the color mode information and the restricted operation state is set.

16 Claims, 13 Drawing Sheets

(56) References Cited

U.S. PATENT DOCUMENTS

| | | | | |
|---|---|---|---|---|
| 2014/0314431 | A1* | 10/2014 | Morihara | G03G 15/1615<br>399/46 |
| 2016/0019443 | A1* | 1/2016 | Iwadate | G06K 15/1803<br>358/1.13 |
| 2016/0216670 | A1* | 7/2016 | Eda | G03G 15/5012 |

* cited by examiner

| | FULL COLOR MODE | MONOCHROMATIC MODE |
|---|---|---|
| PRINT PREPARATION TEMPERATURE | 80°C | 120°C |
| PRINT TEMPERATURE | 150°C | |

| TEMPERATURE DIFFERENCE [PRINT PREPARATION TEMPERATURE - CURRENT TEMPERATURE] | TIME ta |
|---|---|
| 0°C OR LESS | 0 SECONDS |
| ... | ... |
| 50°C | 8 SECONDS |
| ... | ... |

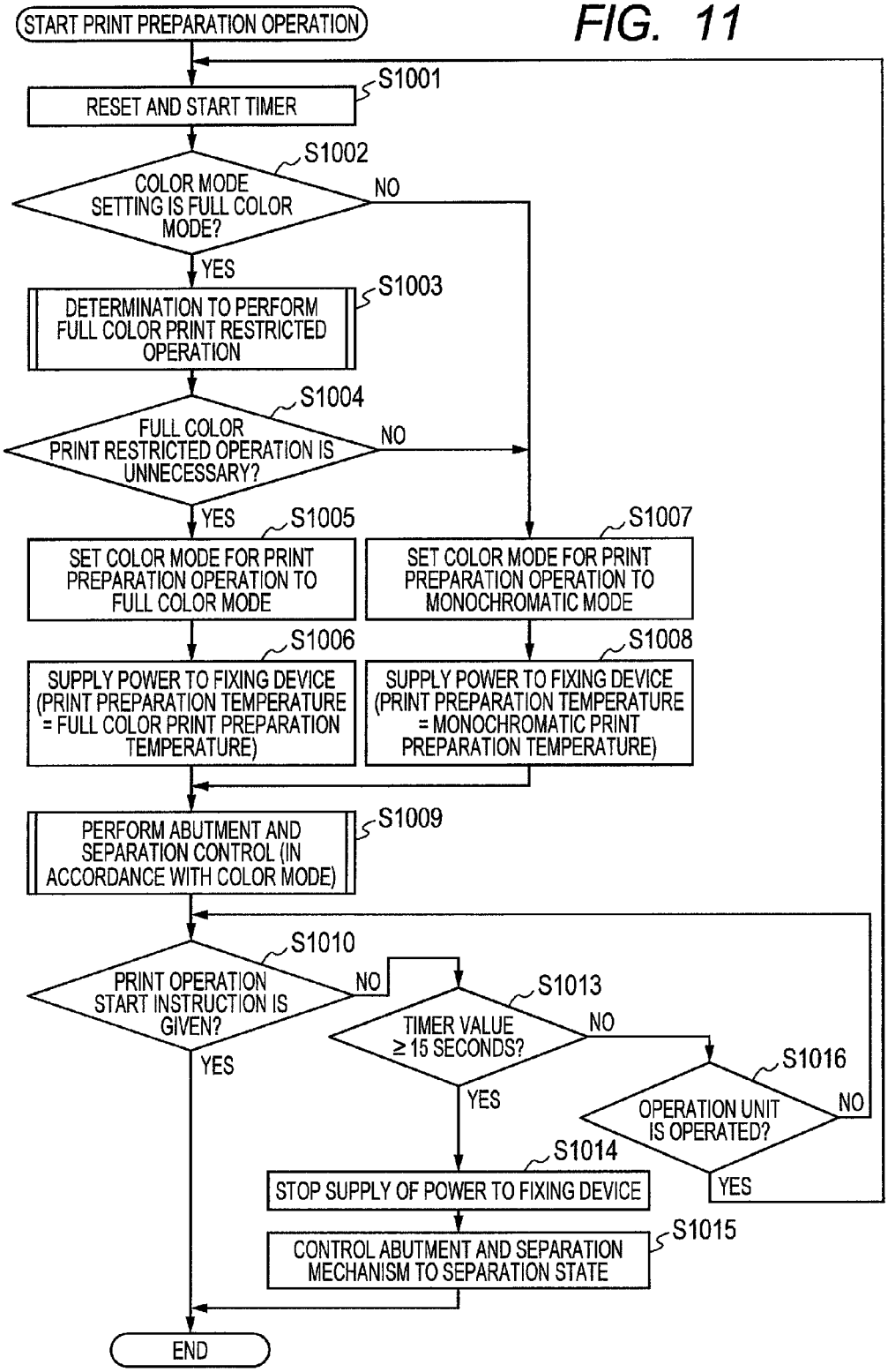
FIG. 11
START PRINT PREPARATION OPERATION
S1001
RESET AND START TIMER
S1002
COLOR MODE SETTING IS FULL COLOR MODE?
NO
YES
S1003
DETERMINATION TO PERFORM FULL COLOR PRINT RESTRICTED OPERATION
S1004
FULL COLOR PRINT RESTRICTED OPERATION IS UNNECESSARY?
NO
YES
S1005
SET COLOR MODE FOR PRINT PREPARATION OPERATION TO FULL COLOR MODE
S1007
SET COLOR MODE FOR PRINT PREPARATION OPERATION TO MONOCHROMATIC MODE
S1006
SUPPLY POWER TO FIXING DEVICE (PRINT PREPARATION TEMPERATURE = FULL COLOR PRINT PREPARATION TEMPERATURE)
S1008
SUPPLY POWER TO FIXING DEVICE (PRINT PREPARATION TEMPERATURE = MONOCHROMATIC PRINT PREPARATION TEMPERATURE)
S1009
PERFORM ABUTMENT AND SEPARATION CONTROL (IN ACCORDANCE WITH COLOR MODE)
S1010
PRINT OPERATION START INSTRUCTION IS GIVEN?
NO
YES
S1013
TIMER VALUE ≥ 15 SECONDS?
NO
YES
S1016
OPERATION UNIT IS OPERATED?
NO
YES
S1014
STOP SUPPLY OF POWER TO FIXING DEVICE
S1015
CONTROL ABUTMENT AND SEPARATION MECHANISM TO SEPARATION STATE
END

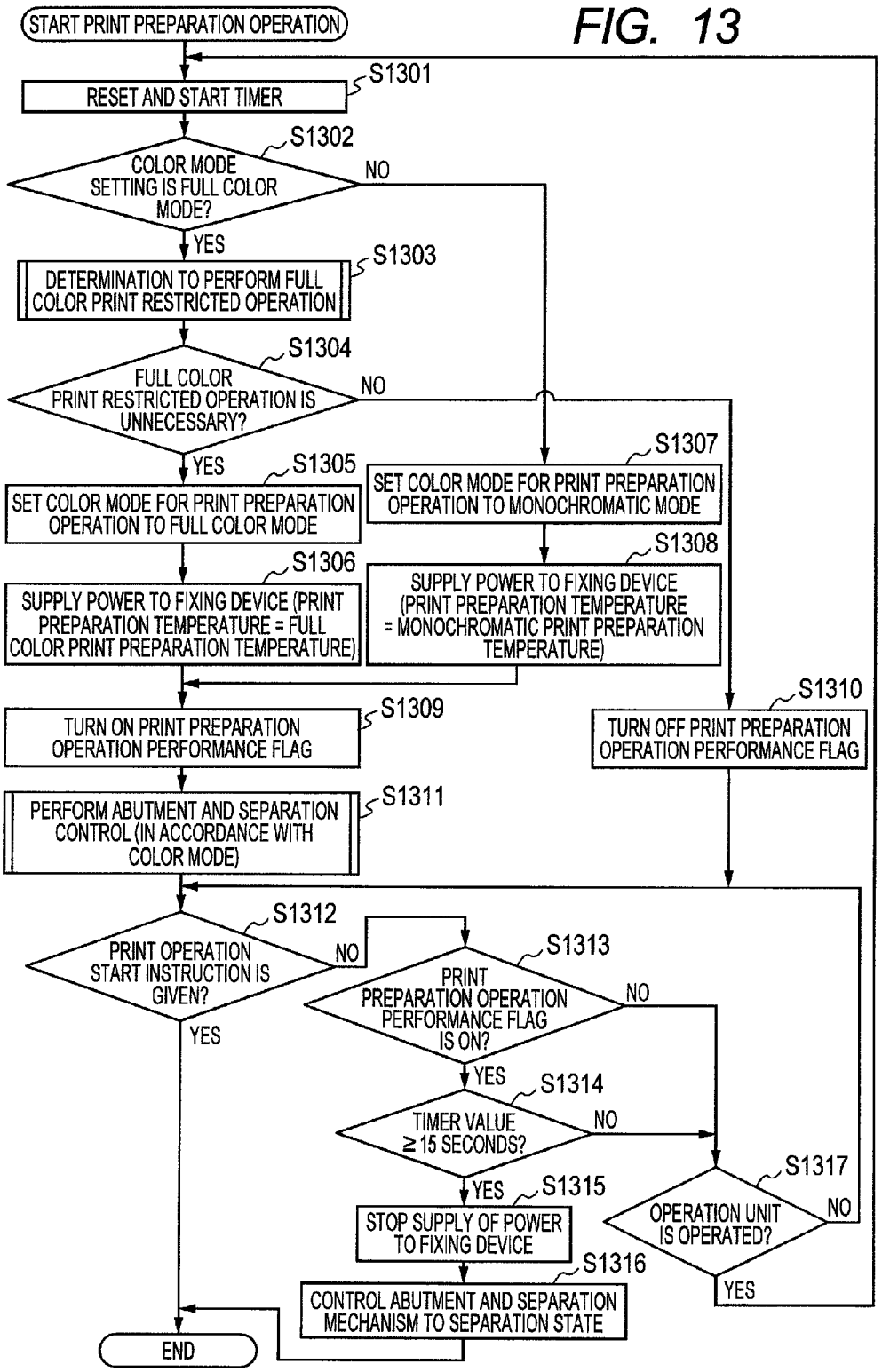
FIG. 13
START PRINT PREPARATION OPERATION
RESET AND START TIMER
S1301
S1302
COLOR MODE SETTING IS FULL COLOR MODE?
NO
YES
DETERMINATION TO PERFORM FULL COLOR PRINT RESTRICTED OPERATION
S1303
S1304
FULL COLOR PRINT RESTRICTED OPERATION IS UNNECESSARY?
NO
YES
S1305
SET COLOR MODE FOR PRINT PREPARATION OPERATION TO FULL COLOR MODE
S1306
SUPPLY POWER TO FIXING DEVICE (PRINT PREPARATION TEMPERATURE = FULL COLOR PRINT PREPARATION TEMPERATURE)
S1307
SET COLOR MODE FOR PRINT PREPARATION OPERATION TO MONOCHROMATIC MODE
S1308
SUPPLY POWER TO FIXING DEVICE (PRINT PREPARATION TEMPERATURE = MONOCHROMATIC PRINT PREPARATION TEMPERATURE)
TURN ON PRINT PREPARATION OPERATION PERFORMANCE FLAG
S1309
S1310
TURN OFF PRINT PREPARATION OPERATION PERFORMANCE FLAG
PERFORM ABUTMENT AND SEPARATION CONTROL (IN ACCORDANCE WITH COLOR MODE)
S1311
S1312
PRINT OPERATION START INSTRUCTION IS GIVEN?
NO
YES
S1313
PRINT PREPARATION OPERATION PERFORMANCE FLAG IS ON?
NO
YES
S1314
TIMER VALUE ≥ 15 SECONDS?
NO
YES
S1315
STOP SUPPLY OF POWER TO FIXING DEVICE
S1316
CONTROL ABUTMENT AND SEPARATION MECHANISM TO SEPARATION STATE
S1317
OPERATION UNIT IS OPERATED?
NO
YES
END

IMAGE FORMING APPARATUS

BACKGROUND OF THE INVENTION

Field of the Invention

The present invention relates to an image forming apparatus, such as a copying machine and a printer, which is configured to perform image formation on a recording material through an electrophotographic method, and more particularly, to a print preparation operation of the image forming apparatus.

Description of the Related Art

In a color image forming apparatus employing an electrophotographic method, a toner image formed on a photosensitive drum is transferred onto an intermediate transfer belt by a primary transfer roller arranged opposed to the photosensitive drum, and this process is repeated for each of a plurality of toner colors. With this, a full color toner image is formed on the intermediate transfer belt. A color image forming apparatus of a so-called tandem type has become the mainstream. In the image forming apparatus of the tandem type, four photosensitive drums, which are configured to form toner images of yellow, magenta, cyan, and black, respectively, are arranged in a rotating direction of the intermediate transfer belt, and the toner images formed on the photosensitive drums are sequentially transferred onto the intermediate transfer belt. The color image forming apparatus have been demanded to shorten a first print output time (hereinafter also referred to as "FPOT") and a first copy output time (hereinafter also referred to as "FCOT"). The FPOT is a period of time from input of a print instruction to output of a first recording material. The FCOT is a period of time from pressing of a copy key to output of a first recording material as a copy of an original. As a method of shortening the time, there has been widely used a technology of performing a print preparation operation before input of an instruction to start printing or an instruction to start copying.

In U.S. Pat. No. 5,107,279, there is proposed a print preparation method. In the proposed print preparation method, when an operation from which a print instruction is predicted, such as an operation to an operation unit of an image forming apparatus or placement of an original to an original reading device, is detected, rotation of a scanner motor is started prior to the print instruction. In general, the scanner motor, which is configured to drive a rotary polygon mirror of an optical scanning device, requires longer time from the start of rotation to stabilization of the rotational speed as compared to other motors necessary for image formation such as a drive motor configured to drive the photosensitive drum. Thus, rotation of the scanner motor is started before the print instruction is received. Such a configuration is advantageous in that printing can be started without a standby time from the input of the print instruction to the stabilization of the rotation of the scanner motor.

In the color image forming apparatus, selection can be made from two color modes including a full color mode of performing image formation with a full color image and a monochromatic mode of performing image formation with a black and white image. In the related art, a print preparation operation control is not switched in accordance with the color mode setting, with the result that the print preparation operation control is not optimum. In view of this, the print preparation operation control can be optimized through switching of the print preparation operation control in accordance with color mode setting which is set through the operation unit. However, for example, there is a problem that, when color toner is used up, and only the monochromatic printing can be performed, the print preparation operation performed in accordance with the color mode setting of the full color mode may disadvantageously cause an unnecessary print preparation operation control to be performed.

SUMMARY OF THE INVENTION

The present invention which has been made under such a circumstance has an object to perform a print preparation operation control in accordance with a state of an image forming portion.

In order to solve the above-mentioned problem, according to one embodiment of the present invention, there is provided an image forming apparatus, including: an image forming unit including a plurality of image forming stations configured to respectively perform image formation of different colors, the image forming unit being configured to perform image formation to a recording sheet in any one of a first mode, in which image formation is performed through use of the plurality of image forming stations, and a second mode, in which image formation is performed through use of a predetermined image forming station among the plurality of image forming stations; an operation unit configured to allow input of color mode information for setting to perform image formation in the first mode or to perform image formation in the second mode; and a controller configured to: i) control the image forming unit to perform a preparation operation for image formation in accordance with the color mode information before image formation when detecting an operation from which a start instruction of image formation is predicted; ii) set a restricted operation state in which the controller prohibits the image formation in the first mode and permits the image formation in the second mode when any one image forming station, except for the predetermined image forming station, among the plurality of image forming stations is incapable of performing image formation, and the predetermined image forming station is capable of performing image formation; and iii) prevent the image forming unit from performing the preparation operation when a performing the image formation in the first mode is set as the color mode information, and the restricted operation state is set.

According to the present invention, the print preparation operation control in accordance with the state of the image forming portion can be performed.

Further features of the present invention will become apparent from the following description of exemplary embodiments with reference to the attached drawings.

BRIEF DESCRIPTION OF THE DRAWINGS

FIG. 11 is a flowchart of a print preparation operation in a comparative embodiment.

FIG. 13 is a flowchart of the print preparation operation in the embodiment.

DESCRIPTION OF THE EMBODIMENTS

Now, an embodiment of the present invention is described in detail with reference to the drawings.

<Schematic Configuration of Image Forming System>

Figure 1:
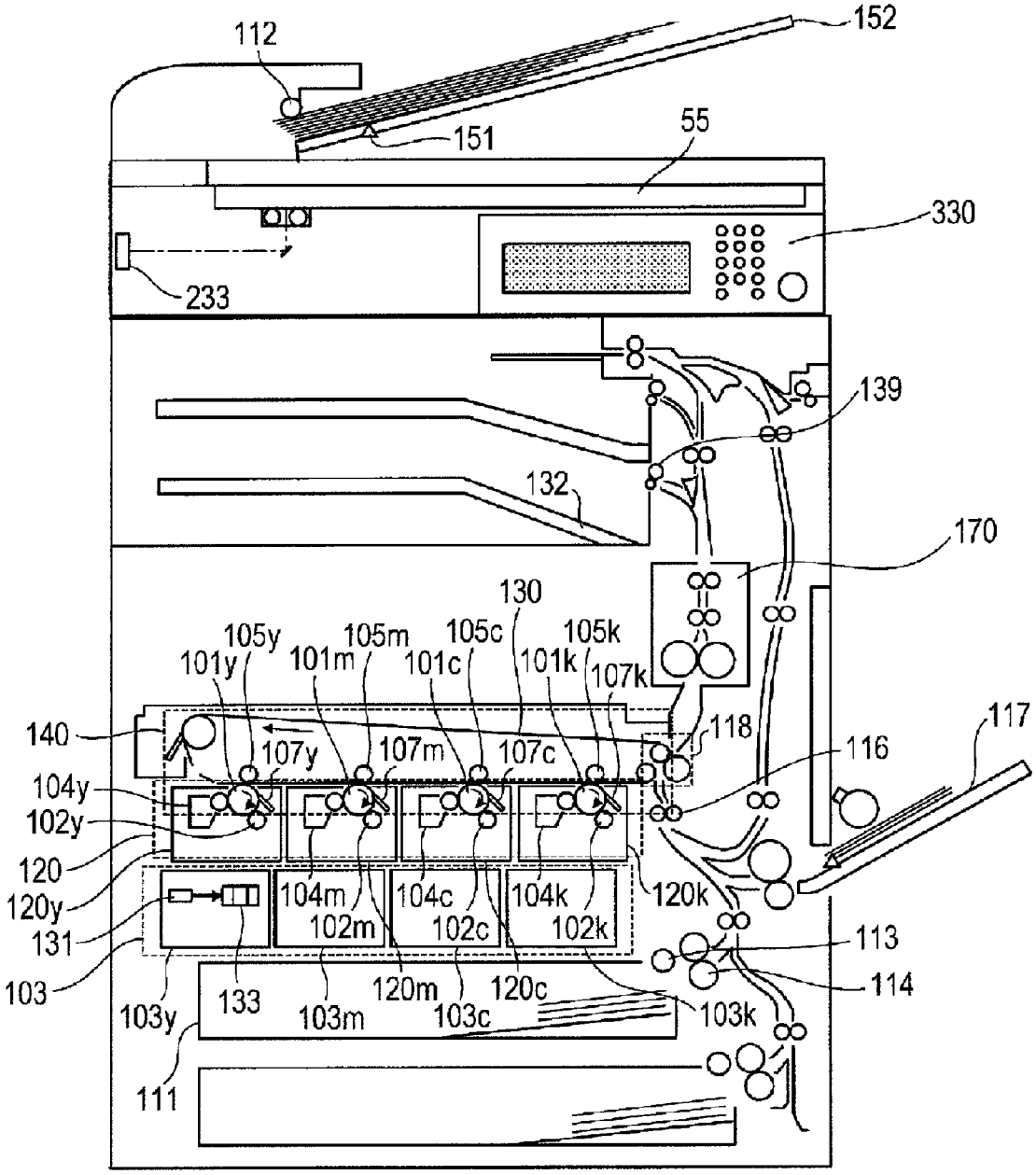
FIG. 1 is a sectional view of an image forming apparatus according to an embodiment of the present invention.
Figure 2:
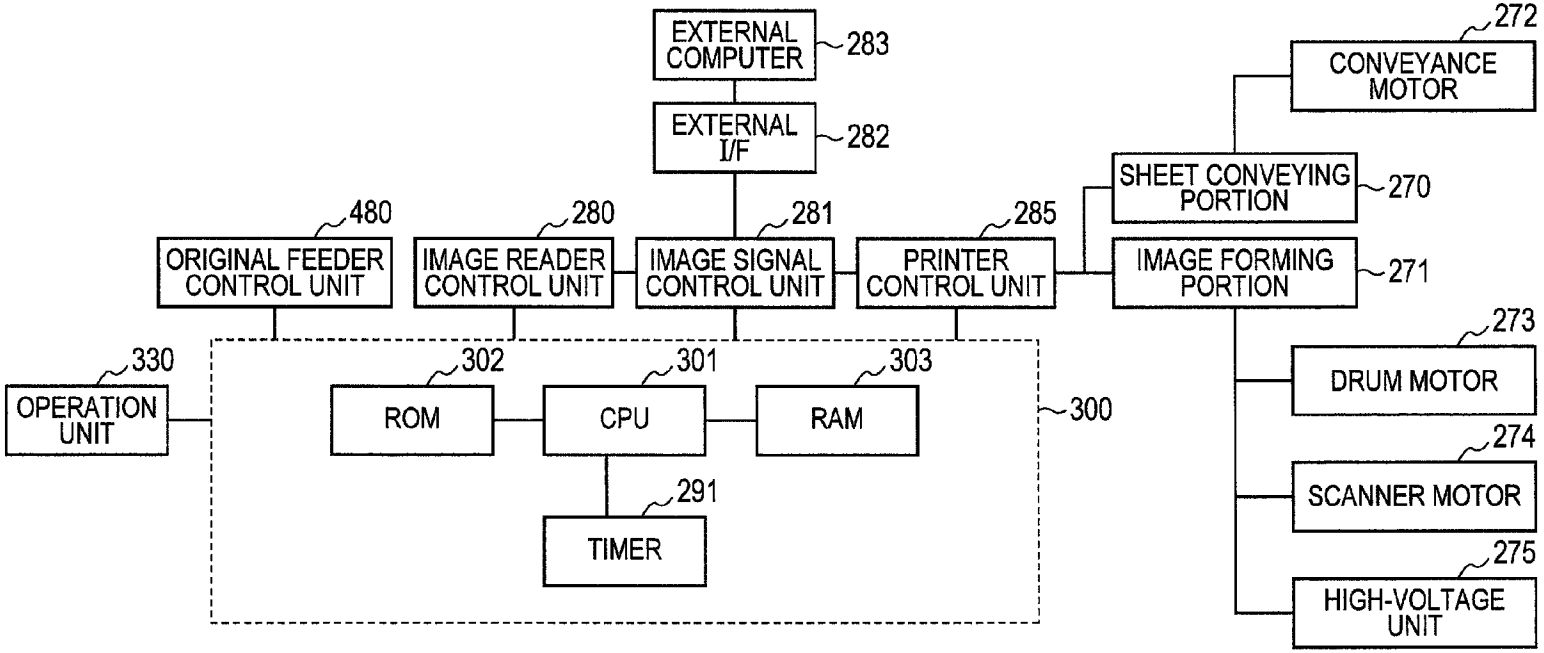
FIG. 2 is a control block diagram of the image forming apparatus according to the embodiment.

FIG. 1 is a sectional view of an image forming apparatus according to this embodiment. FIG. 2 is a control block diagram of the image forming apparatus according to this embodiment. With reference to FIG. 1 and FIG. 2, a basic configuration of the image forming apparatus is described.

[Schematic Configuration of Image Forming Apparatus]

A control portion 300 illustrated in FIG. 2 is configured to perform system control on the image forming apparatus illustrated in FIG. 1. The control portion 300 includes a CPU 301, a ROM 302, a RAM 303, and a timer 291. The CPU 301 being a control unit (controller) is configured to perform system control on the image forming apparatus. The ROM 302 and the RAM 303 are connected to the CPU 301 through an address bus and a data bus. Control programs are written in the ROM 302. The RAM 303 is configured to store variables to be used for the control and image data read by an image sensor 233 illustrated in FIG. 1. The RAM 303 being a storage unit is a non-volatile memory capable of retaining stored values even when supply of power to the image forming apparatus is stopped. The timer 291 capable of measuring time is connected to the CPU 301. Thus, the CPU 301 also sets a time count value of the timer 291 and acquires a measurement value of the timer 291. The CPU 301 drives an original conveying roller 112 and detects presence or absence of an original placed on an original table 152 based on a detecting result obtained by an original presence sensor 151 being a detector. Further, the CPU 301 is configured to detect, through use of an image reader control portion 280, opening and closing operations of an original pressure plate, and is configured to read, through use of an image sensor 233, an image of an original placed on an original pressure plate glass plate 55 or an image of an original fed by an original feeder control portion 480. The image sensor 233 being a reading unit outputs information of an image of a read original as an analog image signal to the CPU 301. The CPU 301 transfers the analog image signal input from the image sensor 233 to an image signal control portion 281.

During a copy operation, the image signal control portion 281 performs various processes after the analog image signal input from the image sensor 233 is converted into a digital image signal. After converting the digital image signal that has been subjected to the various processes into a video signal, the image signal control portion 281 outputs the video signal to a printer control portion 285. In the copy operation, an operation of reading the original with the image sensor 233 and performing a print operation based on the read data is performed. Further, during the print operation performed in response to an instruction from outside, the image signal control portion 281 first performs the various processes on the digital image signal that has been input from an external computer 283 through an external interface (I/F) 282. Then, the image signal control portion 281 converts the digital image signal that has been subjected to the various processes into the video signal, and outputs the video signal to the printer control portion 285.

In accordance with an instruction from the CPU 301, the printer control portion 285 controls image formation by the image forming portion 271, and controls feed and conveyance of a sheet being a recording material by a sheet conveying portion 270. The image forming portion 271 includes an image forming unit 120, an intermediate transfer belt unit 140, a laser scanner unit 103, and a fixing device 170, which are illustrated in FIG. 1. The sheet conveying portion 270 includes a sheet feeding cassette 111, a multi tray 117, and a conveyance motor 272 configured to drive each conveyance roller.

An operation unit 330 is used to input color mode information for image formation (full color mode (first instruction information), monochromatic mode (second instruction information), and automatic (third instruction information)), display a state of the image forming apparatus, and input an instruction such as an instruction to start copying. The selected color mode information is stored in the RAM 303.

[Basic Image Forming Operation of Image Forming Apparatus]

With reference to FIG. 1 and FIG. 2, a basic image forming operation is described. When the CPU 301 detects a print setting instruction, such as a color mode and digit entries input through the operation unit 330, or detects an operation from which an instruction to start printing is predicted, such as the opening and closing of the original pressure plate or the placement of an original, through the original feeder control portion 480 or the image reader control portion 280, the CPU 301 performs the print preparation operation. In the print preparation operation, the CPU 301 starts temperature control for the fixing device 170 (fixing unit). Further, in accordance with the set color mode, the CPU 301 starts controlling switching of abutment and separation states of the intermediate transfer belt unit 140 and driving of a scanner motor 274 in the laser scanner unit 103. Details of the switching of the abutment and separation states of the intermediate transfer belt unit 140 and the print preparation operation are described later.

Next, when receiving the instruction to start the print operation from the operating portion 330, the CPU 301 starts an operation of reading an image of the original via the original feeder control portion 480. The CPU 301 drives the original conveying roller 112 to convey the original from the original table 152 onto a platen glass plate, and irradiates toward the platen glass plate with light of a lamp (not shown). Reflected light from the original is guided to the image sensor 233 through a mirror. Image data of the original that is read by the image sensor 233 is output to the image signal control portion 281. The reading of the original is continued until the reading of the original on the original pressure plate glass plate 55 is completed or until reading of an image of a final original detected by the original presence sensor 151 is completed.

After the switching of the abutment state of the intermediate transfer belt unit 140 is completed, the CPU 301 controls the image forming unit 120 through the image forming portion 271 and starts an image forming operation for image data stored in the RAM 303. The image forming unit 120 includes, for respective colors of toner, an image forming station 120*y* for yellow, an image forming station 120*m* for magenta, an image forming station 120*c* for cyan, and an image forming station 120*k* for black. The suffixes y, m, c, and k representing colors of toner are hereinafter omitted unless otherwise needed. Each laser scanner unit 103 includes a laser light source 131 configured to emit laser light, a rotary polygon mirror 133 configured to deflect the laser light emitted from the laser light source 131, and the scanner motor 274 being a drive portion configured to control rotation of the rotary polygon mirror 133. Further, each laser scanner unit 103 includes a mirror (not shown) configured to reflect the laser light, which is deflected by the rotary polygon mirror 133, to the photosensitive drum 101. The laser light source 131 emits the laser light in accordance with a video signal. In FIG. 1, the laser light source 131 and the rotary polygon mirror 133 are illustrated only in the laser scanner unit 103*y* for yellow. However, each of the laser scanner units for magenta, cyan, and black also has the same configuration.

The image forming unit 120 includes photosensitive drums 101 respectively being a photosensitive member, developing devices 104, charging rollers 102, and photosensitive drum cleaners 107. In the image forming unit 120, surfaces of the photosensitive drums 101 respectively rotated in a direction indicated by the arrow in FIG. 1 (clockwise direction) is charged by the charging rollers 102. After that, latent images are formed on the photosensitive drums 101 by laser light irradiated from the laser scanner units 103 respectively being an exposure unit. The latent images formed on the photosensitive drums 101 (on the photosensitive members) are developed with toner stored in the developing devices 104. After that, the toner images developed on the photosensitive drums 101 are sequentially transferred in superimposition with one another by primary transfer rollers 105, each having a primary transfer voltage applied thereto, onto the intermediate transfer belt 130 being rotated in the direction indicated by the arrow in FIG. 1 (counterclockwise direction), thereby forming a full color toner image. The full color toner image transferred onto the intermediate transfer belt 130 is moved to the secondary transfer portion 118 by rotation of the intermediate transfer belt 130.

The CPU 301 drives the conveyance motor 272 through the sheet conveying portion 270 so as to match a timing of arrival of the toner image on the intermediate transfer belt 130 to the secondary transfer portion 118. The conveyance motor 272 drives a sheet feeding pickup roller 113, sheet feeding rollers 114, registration rollers 116, and delivery rollers 139. With this, the sheet feeding pickup roller 113 is driven to rotate so that sheets are fed and conveyed from the sheet feeding cassette 111 one after another. Then, through application of a secondary transfer voltage at the secondary transfer portion 118, the toner image on the intermediate transfer belt 130 is transferred onto the conveyed sheet. The image forming apparatus of FIG. 1 includes, in addition to the sheet feeding cassette 111, the multi tray 117 capable of placing various types of sheets as a manual feeding unit enabling manual feeding of sheets.

The sheet onto which the toner image has been transferred in the secondary transfer portion 118 is conveyed to the fixing device 170. In the fixing device 170, the unfixed toner image on the sheet is heated and pressurized so as to be fixed onto the sheet. Thereafter, the CPU 301 delivers the sheet to a delivery tray 132 by the delivery rollers 139 that are controlled by the sheet conveying portion 270. The above-mentioned image forming operation is an example, and the present invention is not limited to the above-mentioned configuration. In this embodiment, the laser scanner unit 103 is provided for each photosensitive drum 101. That is, one laser scanner unit 103 is provided for one photosensitive drum 101. For example, one laser scanner unit 103 may perform light exposure for two photosensitive drums 101 or four photosensitive drums 101.

[Full Color Print Restricted Operation]

With reference to FIG. 1, a full color print restricted operation is described. In the image forming apparatus, there is a case where a component for use in the print operation in the full color mode being the first mode has a failure, or a case where a cumulative amount of use of any one of the photosensitive drums has reached a predetermined amount (hereinafter referred to as "having reached the lifetime limit"). In such cases, the CPU 301 prohibits the print operation in the full color mode. For example, the photosensitive drums 101 illustrated in FIG. 1 are driven by drum motors 273 which are arranged for respective photosensitive drums 101. The drum motors 273 include a drum motor configured to drive the photosensitive drum 101*k* and drum motors configured to drive respective photosensitive drums 101*y*, 101*m*, and 101*c*. When any one of the drum motors configured to drive the photosensitive drums 101*y*, 101*m*, and 101*c* except for the drum motor configured to drive the photosensitive drum 101*k* for black has a failure, the CPU 301 determines that the print operation cannot be performed in the full color mode. The drum motor configured to drive the photosensitive drum 101*k* for black is hereinafter referred to as a drum motor k. The drum motors configured to drive the photosensitive drums 101*y*, 101*m*, and 101*c* are hereinafter referred to as drum motors y, m, and c, respectively. At this time, the drum motor k (not shown) configured to drive the photosensitive drum k being a component for use in the print operation in the monochromatic mode being the second mode does not have a failure. Therefore, the CPU 301 can perform the print operation restricted to the monochromatic printing. In this embodiment, such a functional restriction is referred to as a full color print restricted operation (hereinafter also simply referred to as "print restricted operation"). Through the print restricted operation, the image forming apparatus can continue the print operation in the monochromatic mode until a service man repairs the component having a failure. Therefore, the CPU 301 can permit the image forming operation to a user. Components being triggers for the print restricted operation include, for example, the drum motors y, m, and c (not shown) and the laser scanner units 103*y*, 103*m*, and 103*c*, which are operated at the time of printing in the full color mode, or high-voltage units (for yellow, magenta, and cyan) 275 configured to apply high voltages to the primary transfer rollers 105*y*, 105*m*, and 105*c*. Further, also when toner for use in the developing devices 104*y*, 104*m*, or 104*c* is used up, or when the photosensitive drum 101*y*, 101*m*, or 101*c* reaches the lifetime limit, printing cannot be performed in the full color mode. Thus, the CPU 301 performs the print restricted operation.

Figure 3:
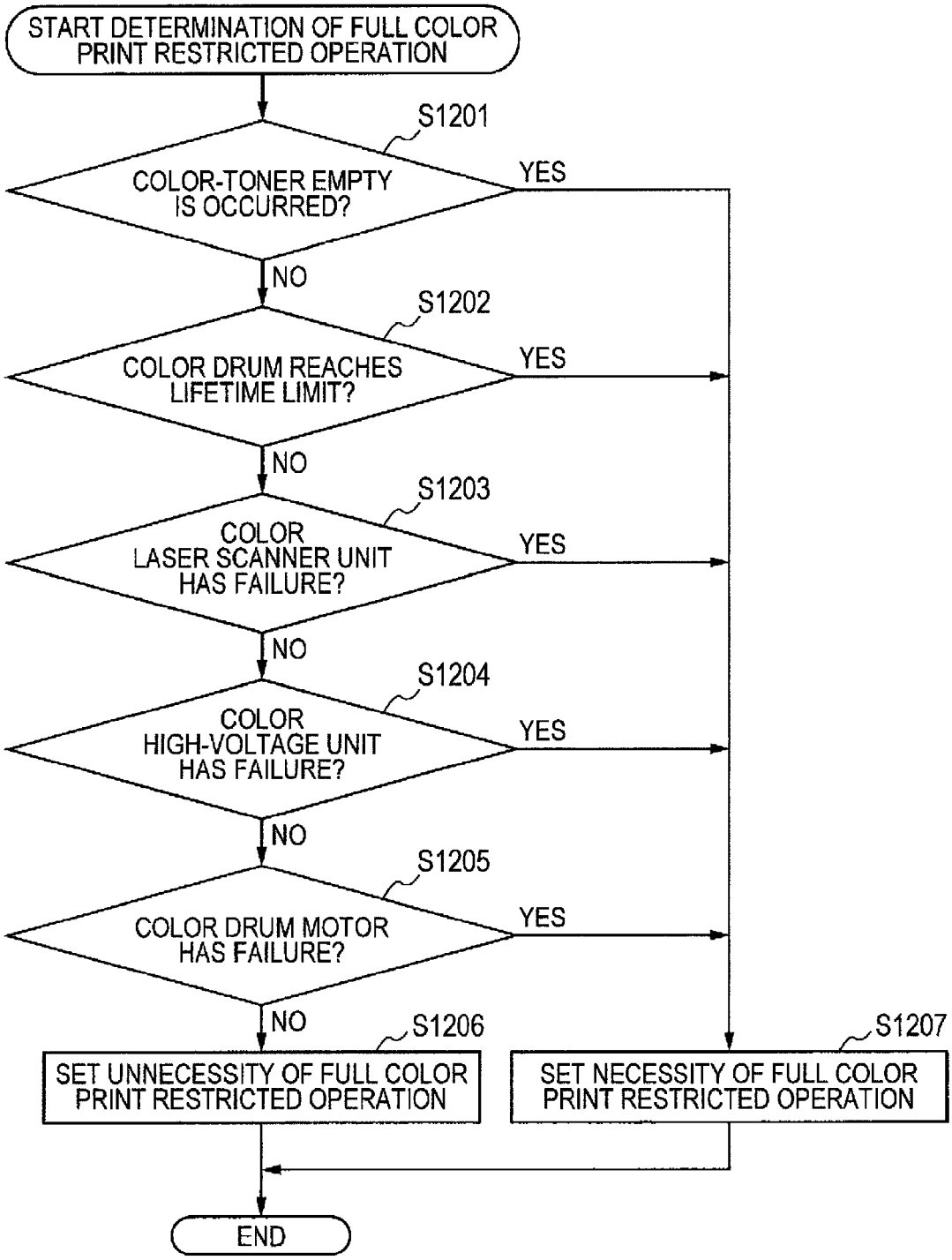
FIG. 3 is a flowchart for determination of a necessity of a full color print restricted operation in the embodiment.

FIG. 3 is a flowchart for illustrating a control sequence which is started at the time of determining a necessity of the print restricted operation and executed by the CPU 301. In FIG. 3, in Step (hereinafter abbreviated as "S") 1201, the CPU 301 determines whether or not color-toner empty occurs. The color-toner empty is determined based on occurrence of a toner-empty state in the developing device 104*y* of the image forming station 120*y* for yellow, the developing device 104*m* of the image forming station 120*m* for magenta, or the developing device 104*c* of the image forming station 120*c* for cyan. When the toner-empty state occurs in any one of the developing devices 104*y*, 104*m*, and 104*c*, the CPU 301 determines that the color-toner empty occurs, and proceeds the processing to S1207. When the color-toner empty does not occur, the CPU 301 proceeds the processing to S1202. The developing devices 104*y*, 104*m*, 104*c*, and 104*k* include hoppers (not shown) configured to replenish corresponding toner, and include detecting portions configured to detect the remaining amounts of toner in the hoppers. The CPU 301 determines the presence or absence of color toner based on the remaining amounts of toner detected by the detecting portions.

In S1202, the CPU 301 determines whether or not the color drums have reached the lifetime limit. The color drums correspond to the photosensitive drum 101*y* of the image forming station 120*y* for yellow, the photosensitive drum 101*m* of the image forming station 120*m* for magenta, and the photosensitive drum 101*c* of the image forming station 120*c* for cyan. When any one of the photosensitive drums 101*y*, 101*m*, and 101*c* has reached the lifetime limit, the CPU 301 determines that the color drum has reached the lifetime limit, and proceeds the processing to S1207. When no color drum has reached the lifetime limit, the CPU 301 proceeds the processing to S1203. The CPU 301 stores, in the RAM 303, information related to the amounts of use of the photosensitive drums 101*y*, 101*m*, 101*c*, and 101*k* from the start of use to a current time. A cumulative rotation time (amount of rotation) of the photosensitive drum is used as the amount of use. Based on this information, the CPU 301 determines whether or not the amount of use of the color drum has reached a predetermined amount to reach the lifetime limit. The lifetime limit of the photosensitive drum may be determined through another method. For example, the CPU 301 may determine the lifetime limit when a current flowing to the photosensitive drum, which is measured by a current detection circuit of the image forming portion, is equal to or less than a predetermined value.

In S1203, the CPU 301 determines whether or not the color laser scanner units have a failure. The color laser scanner units correspond to the layer scanner unit 103*y* configured to irradiate laser light to the photosensitive drum 101*y* of the image forming station 120*y* for yellow, the laser scanner unit 103*m* configured to irradiate laser light to the photosensitive drum 101*m* of the image forming station 120*m* for magenta, and the laser scanner unit 103*c* configured to irradiate laser light to the photosensitive drum 101*c* of the image forming station 120*c* for cyan. When there is a laser scanner unit 103 having a failure in the laser scanner units 103*y*, 103*m*, and 103*c*, the CPU 301 determines that the color laser scanner unit has a failure, and proceeds the processing to S1207. On the contrary, when no laser scanner unit 103 has a failure, the CPU 301 determines that no color laser scanner unit has a failure, and proceeds the processing to S1204. When the motor does not rotate at the time of driving, the scanner motor 274 outputs a lock signal. The CPU 301 detects a failure in the color laser scanner units based on whether or not each the scanner motor for the laser scanner units 103*y*, 103*m*, 103*c*, and 103*k* outputs the lock signals.

In S1204, the CPU 301 determines whether or not the color high-voltage units have a failure. The color high-voltage units correspond to high-voltage units (for yellow, magenta, and cyan) 275 configured to apply the primary transfer voltages to the primary transfer roller 105*y* of the image forming station 120*y* for yellow, the primary transfer roller 105*m* of the image forming station 120*m* for magenta, and the primary transfer roller 105*c* of the image forming station 120*c* for cyan, respectively. When there is a high-voltage unit having a failure in the high-voltage units (for yellow, magenta, and cyan) 275, the CPU 301 determines that the high-voltage unit has a failure, and proceeds the processing to S1207. On the contrary, when no high-voltage unit has a failure, the CPU 301 determines that no high-voltage unit has a failure, and proceeds the processing to S1205. The CPU 301 detects a failure in each color high-voltage unit based on current value detected at the time of application of the primary transfer voltage by a detecting portion configured to detect a current flowing to each primary transfer roller 105.

In S1205, the CPU 301 determines whether or not the color drum motors have a failure. The color drum motors correspond to the drum motor y configured to drive the photosensitive drum 101*y* of the image forming station 120*y* for yellow, the drum motor m configured to drive the photosensitive drum 101*m* of the image forming station 120*m* for magenta, and the drum motor c configured to drive the photosensitive drum 101*c* of the image forming station 120*c* for cyan. When there is a drum motor having a failure in the drum motors y, m, and c, the CPU 301 determines that the color drum motor has a failure, and proceeds the processing to S1207. On the contrary, when no drum motor has a failure, the CPU 301 determines that no color drum motor has a failure, and proceeds the processing to S1206.

In S1206, the CPU 301 stores, in the RAM 303, information indicating that the print restricted operation is not necessary, and terminates the processing. In S1207, the CPU 301 stores, in the RAM 303, information indicating that the print restricted operation is necessary, and terminates the processing. The components subjected to the above-mentioned print restricted operation are examples, and the present invention is not limited to the configuration described above.

<Control for Image Forming Apparatus in accordance with Color Mode>

[Setting of Color Mode]

Figure 4A:
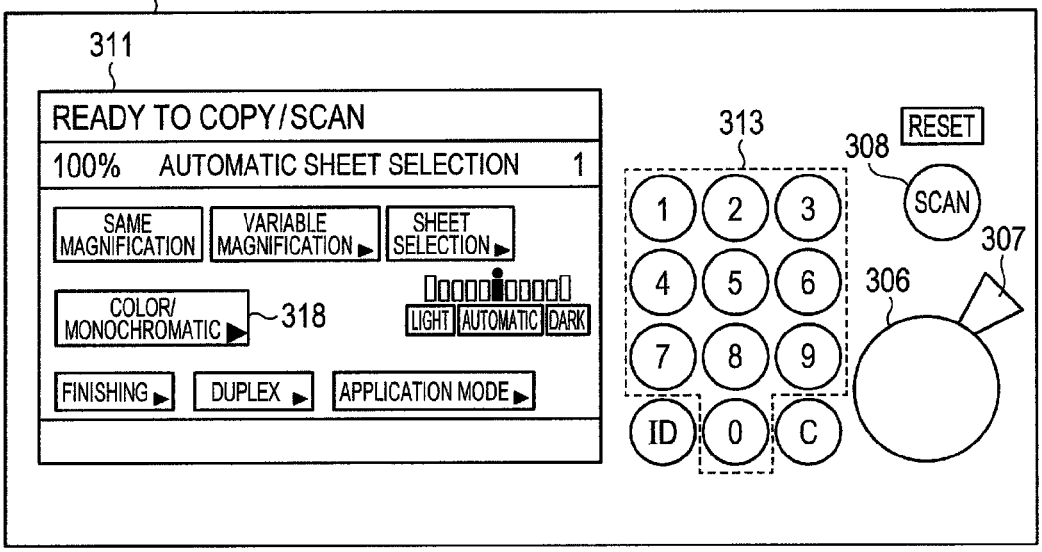
FIG. 4A is a schematic front view of an operation unit.
Figure 4B:
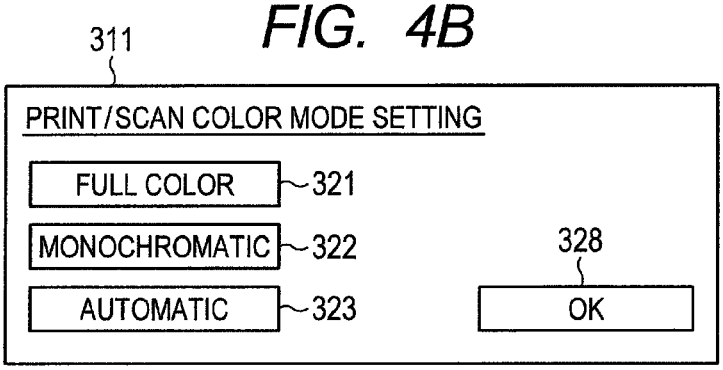
FIG. 4B is an illustration of a pop-up setting screen.

FIG. 4A is a front view of the operating portion 330 according to this embodiment. A start key 306 for starting the copy operation, a stop key 307 for stopping the copy operation, and a numerical keypad 313 for setting the digit entries are arranged on the operating portion 330. A display portion 311 including a touch panel is arranged on the left of the operating portion 330. On a screen of the display portion 311, soft keys can be created. When a "COLOR/MONOCHROMATIC" key 318 displayed on the display portion 311 is pressed, the screen illustrated in FIG. 4B is popped up on the display portion 311. Thus, setting of a color mode for a printing or scanning operation of the image forming apparatus can be performed. FIG. 4B is an illustration of a pop-up setting screen configured to enable setting of the color mode for the printing or scanning operation. When a key operation is performed with respect to the display screen illustrated in FIG. 4B, setting of the color mode for the printing or scanning operation is performed. The color mode is designated through a "FULL COLOR" key 321 for designation of the full color mode, a "MONOCHROMATIC" key 322 for designation of the monochromatic mode, and an "AUTOMATIC" key 323 enabling the image forming apparatus to make determination and decision to set the full color mode or the monochromatic mode. When any one of those keys is selected, and an "OK" key 328 is pressed, setting of the color mode for the printing or scanning operation is performed.

Setting can be performed through the "FULL COLOR" key 321 and the "AUTOMATIC" key 323 even under the print restricted operation state in which the print operation cannot be performed in the full color mode. This is because, when the setting of the color mode is not permitted during the print restricted operation, processing of reading a color original cannot be performed in a case where the original scanning operation is to be performed through an original reading device (reader) being an input unit.

The CPU 301 can obtain a set value which is set through the operation unit 330, and the set value is stored in the RAM 303. Further, when the operation to the operation unit 330 is detected, or when the placement of an original on the original table 152 is detected by the original presence sensor 151, the CPU 301 performs the print preparation operation control in accordance with color mode setting stored in the RAM 303. Further, also when completion of initialization processing, which is performed at the time of power-on or restoration from the power saving mode, is detected, the CPU 301 performs the print preparation operation control in accordance with the color mode setting stored in the RAM 303. In this embodiment, the color mode is set through operation to the color mode setting keys through the operation unit 330. However, for example, the color mode setting may be input from the external computer 283 through the external I/F 282.

In this embodiment, as the print preparation operation, the temperature of the fixing device 170 is shifted to a predetermined temperature in accordance with the color mode setting, and the abutment and separation states of the intermediate transfer belt unit 140 are switched in accordance with the color mode setting. Details thereof are described later.

[Switching Control for Abutment and Separation Mechanism in Accordance with Color Mode]

Description is made of the abutment and separation mechanism of this embodiment being a switching unit, which is configured to switch the abutment and separation states of the intermediate transfer belt 130 and the photosensitive drum 101 in the full color mode and the monochromatic mode.

(Description of Configurations of Photosensitive Drum and Intermediate Transfer Belt)

Figure 5A:
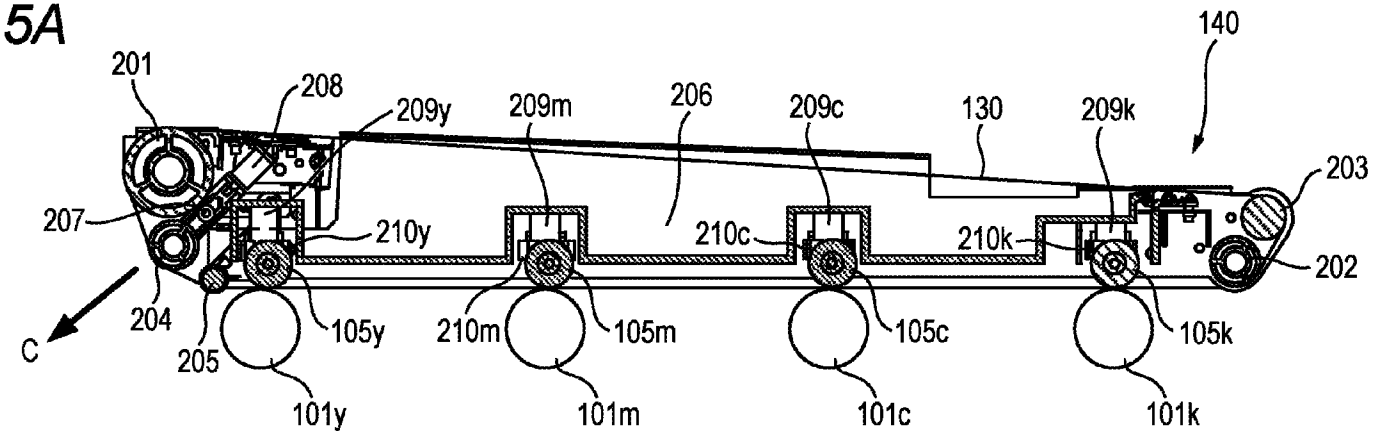
FIG. 5A is a sectional view of the vicinity of an intermediate transfer belt unit in a case where a full color mode is set.
Figure 5B:
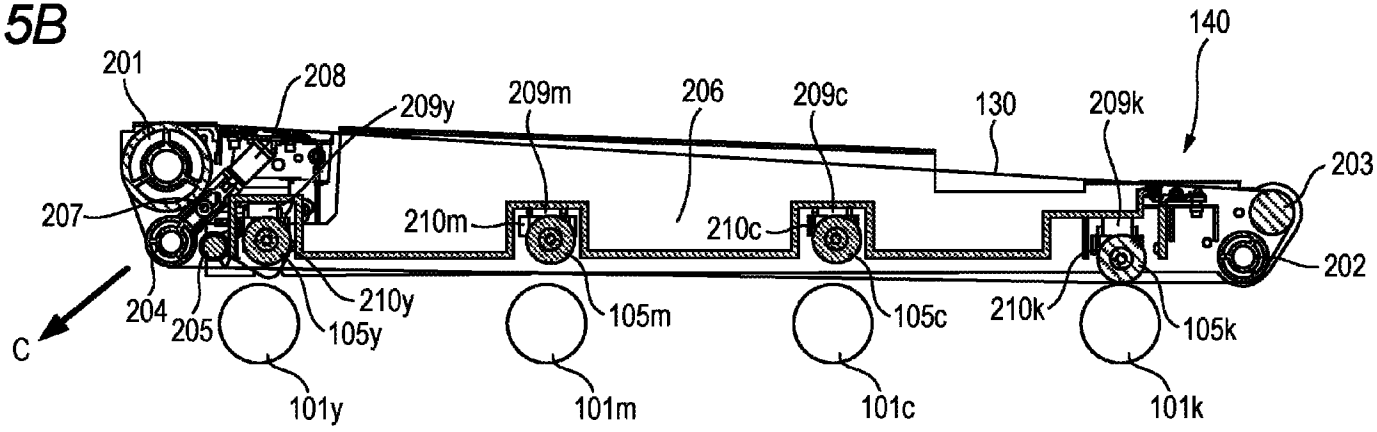
FIG. 5B is a sectional view of the vicinity of the intermediate transfer belt unit in a case where a monochromatic mode is set.

FIG. 5A and FIG. 5B are sectional views of the vicinity of the intermediate transfer belt unit 140 to which this embodiment is applied. As illustrated in FIG. 5A, the intermediate transfer belt 130 is stretched around five rollers including a drive roller 201, an idler roller 202, a secondary transfer inner roller 203, a tension roller 204, and an auxiliary roller 205. Those rollers are driven by a motor (not shown) for the intermediate transfer belt to rotate, and the intermediate transfer belt 130 is driven by rotation of the rollers to rotate. The drive roller 201, the idler roller 202, and the secondary transfer inner roller 203 are supported on a frame 206 of the intermediate transfer belt unit 140 so as to be rotatable. The tension roller 204 is supported by a bearing 207, which is movable in a direction indicated by the arrow C in FIG. 5A with respect to the frame 206, in the vicinity of both ends of the tension roller 204 so as to be rotatable. The bearing 207 is urged in a movable direction (the direction indicated by the arrow C in FIG. 5A) by a spring 208, and the intermediate transfer belt 130 is stretched at a constant tension. On an inner side of the intermediate transfer belt unit 140, there are arranged the primary transfer rollers 105 which are opposed to the photosensitive drums 101 with the intermediate transfer belt 130 being disposed therebetween. Both ends of each of the primary transfer rollers 105 are supported by a bearing 210 so as to be rotatable. The bearing 210 is guided by the frame 206 so as to be movable in one direction (up-and-down direction in FIG. 5A), and is urged by a spring 209 toward the photosensitive drum 101. The photosensitive drums 101 are driven by the drum motors 273 which are arranged so as to correspond to the photosensitive drums 101, respectively.

FIG. 5A is a sectional view of the vicinity of the intermediate transfer belt unit 140 in the case where the full color mode is set as the color mode. FIG. 5B is a sectional view of the vicinity of the intermediate transfer belt unit 140 in the case where the monochromatic mode is set as the color mode. When the full color mode is set, image formation using toner of all colors is required. Thus, all of the primary transfer rollers 105*y*, 105*m*, 105*c*, and 105*k* are brought into abutment against the opposed photosensitive drums 101*y*, 101*m*, 101*c*, and 101*k* through intermediation of the intermediate transfer belt 130. The state illustrated in FIG. 5A is hereinafter referred to as "abutment mode".

When the monochromatic mode is set as the color mode, image formation using only the black toner is performed. Thus, the photosensitive drum 101*k* for black and the primary transfer roller 105*k* opposed thereto are brought into abutment against each other through intermediation of the intermediate transfer belt 130. Other primary transfer rollers 105*y*, 105*m*, and 105*c* are separated from the intermediate transfer belt 130 and the opposed photosensitive drums 101*y*, 101*m*, and 101*c*. The drum motors, which are configured to drive the photosensitive drums 101*y*, 101*m*, and 101*c* being separated, are stopped. As illustrated in FIG. 5B, the primary transfer roller 105*y* for yellow, the primary transfer roller 105*m* for magenta, the primary transfer roller 105*c* for cyan, and the auxiliary roller 205 are retreated upward in FIG. 5B, and are brought into a separation state of not being held in abutment against the intermediate transfer belt 130. The intermediate transfer belt 130 is not even held in abutment against the photosensitive drum 101*y* for yellow, the photosensitive drum 101*m* for magenta, and the photosensitive drum 101*c* for cyan. Only the primary transfer roller 105*k* for black is held in abutment against the photosensitive drum 101*k* for black through intermediation of the intermediate transfer belt 130. The state illustrated in FIG. 5B is hereinafter referred to as "separation mode".

(Configuration of Abutment and Separation Switching Mechanism and Control Therefor)

Figure 6A:
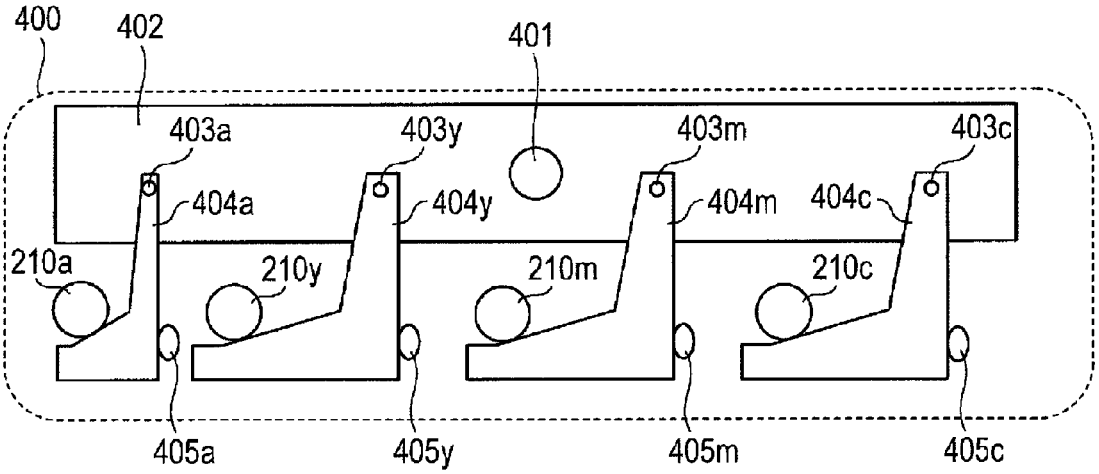
FIG. 6A illustrates an abutment and separation mechanism for the intermediate transfer belt unit in an abutment mode.
Figure 6B:
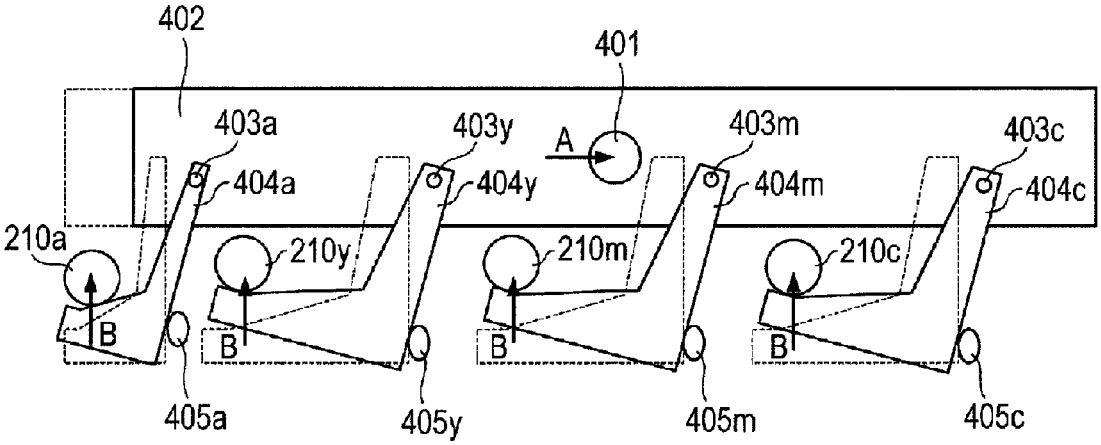
FIG. 6B illustrates the abutment and separation mechanism for the intermediate transfer belt unit in a separation mode.

Next, with reference to FIG. 6A, FIG. 6B, FIG. 7A to FIG. 7E, FIG. 8A, and FIG. 8B, a switching mechanism configured to switch between the abutment mode and the separation mode is specifically described. FIG. 6A and FIG. 6B are sectional views for illustrating an abutment and separation mechanism 400 as viewed from a front side of the intermediate transfer belt unit 140 illustrated in FIG. 5A and FIG. 5B. The abutment and separation mechanism 400 is arranged inside the intermediate transfer belt unit 140 to perform switching between the abutment mode and the separation mode. Further, the abutment and separation mechanism 400 performs switching between the abutment mode and the separation mode through sliding of a slider 402 in a horizontal direction (right-and-left direction in FIG. 6A and FIG. 6B). FIG. 6A is an illustration of a state before sliding of the slider 402, that is, a state in the abutment mode. FIG. 6B is an illustration of a state after sliding of the slider 402 in the direction indicated by the arrow A in FIG. 6B, that is, a state in the separation mode. Actions of the slider 402 at the time of sliding are described later.

The abutment and separation mechanism 400 is described with reference to FIG. 6A. A slide lever 401 is fixedly connected to the slider 402. Bearings 210*a*, 210*y*, 210*m*, and 210*c* are support portions configured to support both ends of each of the auxiliary roller 205, the primary transfer roller 105*y* for yellow, the primary transfer roller 105*m* for magenta, and the primary transfer roller 105*c* for cyan, respectively so as to be rotatable. Lift arms 404*a*, 404*y*, 404*m*, and 404*c* are configured to support, from a lower side in FIG. 6A, the bearing 210*a* for the auxiliary roller 205, the bearing 210*y* for the primary transfer roller 105*y*, the bearing 210*m* for the primary transfer roller 105*m*, and the bearing 210*c* for the primary transfer roller 105*c*, respectively. Further, the lift arms 404*a*, 404*y*, 404*m*, and 404*c* are supported in a rotatable state by bearings 403*a*, 403*y*, 403*m*, and 403*c*, respectively, which are connection portions with respect to the slider 402. Further, there are arranged lift arm support portions 405*a*, 405*y*, 405*m*, and 405*c* serving as fulcrums for rotation of the lift arms 404*a*, 404*y*, 404*m*, and 404*c*.

Figure 7A:
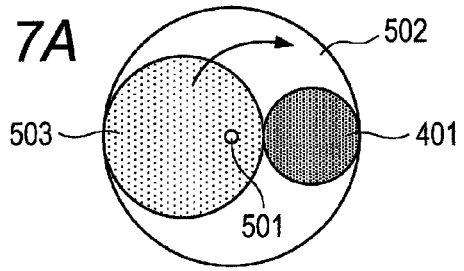
FIG. 7A illustrates an operation of a cam mechanism in the embodiment.

FIG. 7A to FIG. 7E are explanatory views for illustrating a cam mechanism configured to slide the slider 402 of FIG. 6A and FIG. 6B in the horizontal direction (right-and-left direction in FIG. 6A and FIG. 6B). In FIG. 7A, a cam gear 502 and a cam portion 503 are fixed to a shaft 501. When the shaft 501 is rotated in the direction indicated by the arrow in FIG. 7A, the cam gear 502 and the cam portion 503 are also rotated in the direction indicated by the arrow in FIG. 7A along with the rotation of the shaft 501. The slide lever 401 fixedly connected to the slider 402 is arranged in contact with the cam portion 503 of the cam gear 502. FIG. 7A is an illustration of a state in which the cam portion 503 does not interfere with the slide lever 401. That is, FIG. 7A is an illustration of a state in which the cam portion 503 does not press the slide lever 401 rightward in FIG. 7A, and is also an illustration of the state of the abutment and separation mechanism 400 of FIG. 6A. In FIG. 6A, as compared to FIG. 6B, the bearings 210*a*, 210*y*, 210*m*, and 210*c* are positioned on a lower side, and the primary transfer roller 105*y* for yellow, the primary transfer roller 105*m* for magenta, the primary transfer roller 105*c* for cyan, and the auxiliary roller 205 are also positioned on a lower side. That is, FIG. 6A is an illustration of the abutment mode under the abutment state in which the primary transfer rollers 105*y*, 105*m*, and 105*c* are held in contact with the intermediate transfer belt 130.

Figure 7B:
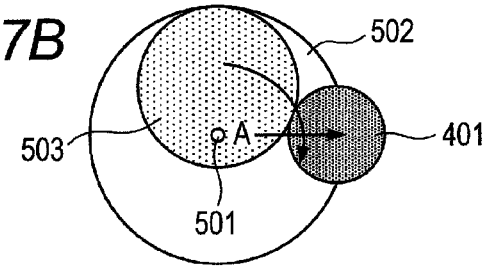
FIG. 7B illustrates the operation of the cam mechanism in the embodiment.
Figure 7C:
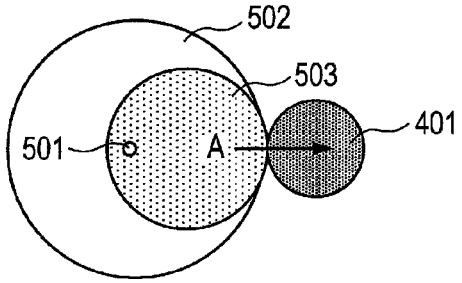
FIG. 7C illustrates the operation of the cam mechanism in the embodiment.
Figure 7D:
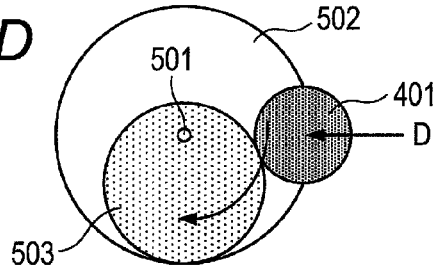
FIG. 7D illustrates the operation of the cam mechanism in the embodiment.
Figure 7E:
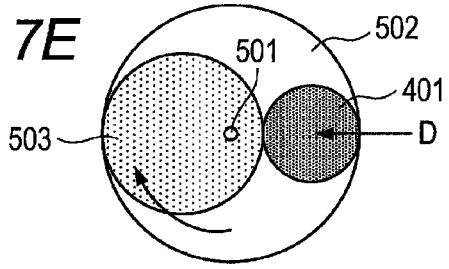
FIG. 7E illustrates the operation of the cam mechanism in the embodiment.
Figure 8A:
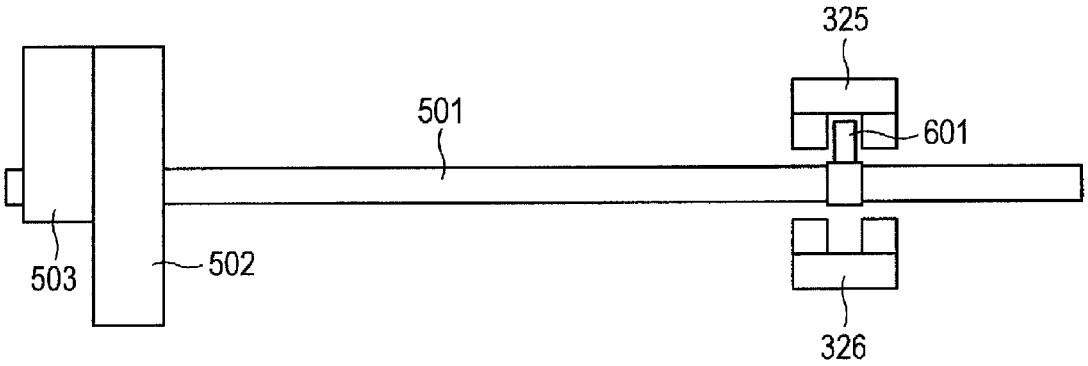
FIG. 8A illustrates the cam mechanism, an abutment sensor, and a separation sensor in the abutment mode.
Figure 8B:
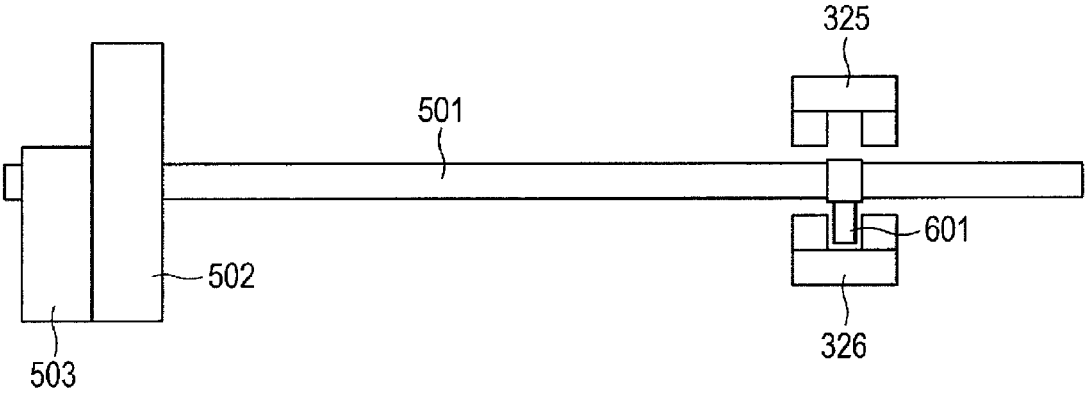
FIG. 8B illustrates the cam mechanism, the abutment sensor, and the separation sensor in the separation mode.

FIG. 8A and FIG. 8B are top views for illustrating the cam gear 502, the cam portion 503, and the shaft 501 illustrated in FIG. 7A to FIG. 7E as viewed from an upper side of FIG. 7A to FIG. 7E. As illustrated in FIG. 8A, the cam gear 502 and the cam portion 503 are fixed to the shaft 501. Further, a flag 601 configured to detect abutment and separation is fixed to the shaft 501. The flag 601 is rotated along with the rotation of the shaft 501. At positions opposed to the flag 601, there are arranged an abutment sensor 325 and a separation sensor 326 with the shaft 501 being disposed therebetween. The abutment sensor 325 and the separation sensor 326 employ photo-interrupters configured to detect the presence or absence of an object through blocking of a light beam. That is, the abutment sensor 325 and the separation sensor 326 have the same configuration, and are each configured to receive a light beam, which is emitted from a light emitting portion arranged on one wall portion along which the flag 601 passes, at a light receiving portion, which is arranged on another wall portion. The abutment sensor 325 and the separation sensor 326 are configured to detect changes in two light-receiving states including a light-receiving state and a light-blocking state. In the light-receiving state, the light beam emitted from the light emitting portion can be received at the light receiving portion. In the light-blocking state, the light beam is blocked by the flag 601 and cannot be received at the light receiving portion. For example, FIG. 8A is an illustration of the state of FIG. 7A. In FIG. 8A, the flag 601 blocks the light in the abutment sensor 325. Thus, it can be determined that the abutment and separation mechanism 400 is in the abutment state (abutment mode). At this time, the flag 601 does not block the light in the separation sensor 326. Thus, the light beam emitted from the light emitting portion can be received at the light receiving portion, and thus it is not determined that the abutment and separation mechanism 400 is in the separation state (separation mode).

Description is made of an operation which is performed when an abutment and separation motor (not shown) configured to drive the abutment and separation mechanism 400 is driven. Through driving of the abutment and separation motor (not shown), the shaft 501 illustrated in FIG. 7A is rotated, and the cam gear 502 is rotated in the direction indicated by the arrow (clockwise direction) along with the rotation of the shaft 501. In FIG. 7B, the rotation of the cam gear 502 causes the cam portion 503 to push the slide lever 401 in the direction indicated by the arrow A. FIG. 7C is an illustration of a state after rotation of the cam portion 503 by 180° from FIG. 7A. At this time, the slide lever 401 is pushed at most in the direction indicated by the arrow A. The slide lever 401 is fixedly connected to the slider 402. Thus, in FIG. 7C, the slider 402 is pushed at most in the direction indicated by the arrow A.

FIG. 6B is an illustration of the state of the abutment and separation mechanism 400 at the above-mentioned timing. In FIG. 6B, portions are illustrated with the solid lines and the broken lines for comparison. A state of the portions illustrated with the broken lines corresponds to the state illustrated in FIG. 6A (abutment mode), and a state of the portions illustrated with the solid lines corresponds to an original state of FIG. 6B. In FIG. 6B, with the movement of the slider 402 in the direction indicated by the arrow A as a point of action, and the lift arm support portions 405*a*, 405*y*, 405*m*, and 405*c* as fulcrums, the lift arms 404*a*, 404*y*, 404*m*, and 404*c* are rotated in the clockwise direction from the state of the broken lines to the state of the solid lines. With this, the bearings 210*a*, 210*y*, 210*m*, and 210*c* respectively supported by ends of the lift arms 404*a*, 404*y*, 404*m*, and 404*c* are pushed upward in the direction indicated by the arrow B in FIG. 6B. When the bearings 210*a*, 210*y*, 210*m*, and 210*c* are pushed upward, the primary transfer rollers 105*y*, 105*m*, and 105*c* which are respectively supported by the bearings 210*y*, 210*m*, and 210*c* are also pushed upward. As a result, the primary transfer rollers 105*y*, 105*m*, and 105*c* are brought into the separation state (separation mode) of not being held in contact with the intermediate transfer belt 130. FIG. 8B is an illustration of the state of the flag 601 at that timing. In FIG. 8B, the flag 601 blocks the light in the separation sensor 326, and it can be determined that the abutment and separation mechanism 400 is in the separation state (separation mode). At this time, the flag 601 does not block the light in the abutment sensor 325, and the light beam emitted from the light emitting portion is received at the light receiving portion. Thus, it is not determined that the abutment and separation mechanism 400 is in the abutment state (abutment mode). The above-mentioned method and configuration for the abutment and separation detection are examples, and thus the present invention is not limited to the above-mentioned configuration. For example, the separation state may be achieved through movement of the photosensitive drums 101 with respect to the intermediate transfer belt 130, or through movement of both the photosensitive drums 101 and the intermediate transfer belt 130.

When the abutment and separation motor is driven from the state of FIG. 7C to rotate the cam gear 502 in the direction indicated by the arrow (clockwise direction), as illustrated in FIG. 7D, the slide lever 401 having been pushed by the cam portion 503 slides in the direction indicated by the arrow D. The slide lever 401 slides in the direction indicated by the arrow D, which is a direction reverse to the direction indicated by the arrow A. At last, the slide lever 401 returns to an initial position as illustrated in FIG. 7E, that is, returns to the abutment state (abutment mode) illustrated in FIG. 6A. The above-mentioned configuration of the abutment and separation mechanism 400 is an example, and the present invention is not limited to the above-mentioned configuration.

When the color mode is in the monochromatic mode, the abutment and separation mechanism 400 is set to the separation mode, thereby being capable of reducing abrasion of the surfaces of the photosensitive drums 101*y*, 101*m*, and 101*c* due to friction with the intermediate transfer belt 130. With this, as compared to the case of not being separated, the lifetime limit of the photosensitive drums 101*y*, 101*m*, and 101*c* can be extended. Further, along with the separation, the drum motors (not shown) configured to drive the photosensitive drums 101*y*, 101*m*, and 101*c* can also be stopped, thereby being capable of achieving power saving.

At the time of print standby, the image forming apparatus according to this embodiment is set to standby under a state in which the intermediate transfer belt unit 140 is separated (state in the separation mode). Thus, when the image formation is completed, or when the print preparation operation is performed but timeout occurs due to no input of a job for a predetermined period of time, the state is shifted to the state of the separation mode. Therefore, when the image formation is to be performed in the full color mode, it is necessary to shift the intermediate transfer belt unit 140 to the state of the abutment mode before starting the image formation. In this embodiment, the intermediate transfer belt unit 140 is shifted to the abutment mode or to the separation mode during the print preparation operation prior to the print operation. With this, the time for switching of the abutment and separation modes before the start of the image formation is reduced, thereby being capable of shortening the first copy output time.

Even when the abutment and separation state at the time of print standby is any one of the state in the separation mode or the state of retaining the state in the abutment mode for the image formation, time for switching the abutment and separation modes is required before the print operation is to be performed in a different mode. In this embodiment, the abutment and separation modes are switched prior to the print operation, and it is not limited to the abutment and separation states at the time of print standby.

[Adjustment Control for Temperature of Fixing Device]

Description is made of an adjustment control for a fixing temperature of the fixing device 170 in the full color mode and in the monochromatic mode in this embodiment.

(Configuration of Fixing Device)

Figure 9:
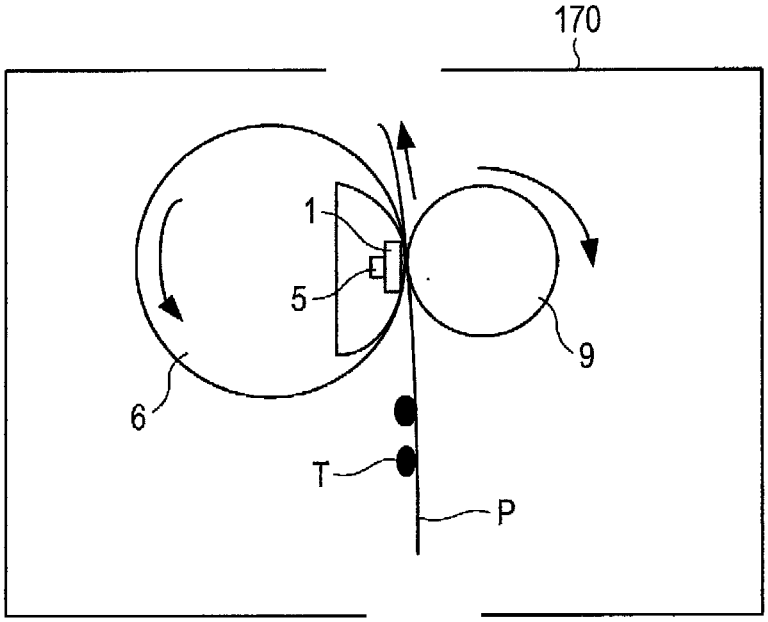
FIG. 9 is a sectional view of a fixing device in the embodiment.

FIG. 9 is a sectional view of the fixing device 170 being a fixing unit configured to fix an unfixed toner image T, which has been transferred onto a recording material by the secondary transfer portion 118, on a recording material P. In FIG. 9, the fixing device 170 includes a fixing film 6, a pressure roller 9, a heater 1, and a thermistor 5. The fixing film 6 is a fixing body formed of a cylindrical metal member. The thermistor 5 is a temperature detector. The pressure roller 9 is driven by a fixing drive motor (not shown) to rotate. The pressure roller 9 is arranged at a position opposed to the heater 1 with the fixing film 6 being disposed therebetween, and is brought into press contact with a lower surface of the heater 1 by an urging spring (not shown) at a pressing force of, for example, from 5 kgf to 20 kgf. The fixing film 6 is driven in the direction indicated by the arrow (counterclockwise direction) which is a forward direction with respect to a conveying direction of the recording material P along with the rotation of the pressure roller 9 in the direction indicated by the arrow (clockwise direction).

The fixing film 6 forms a fixing nip portion with the pressure roller 9. The heater 1 is arranged to heat the recording material P which passes through the fixing nip portion. The heater 1 receives supply of power at both ends thereof in the longitudinal direction (direction perpendicular to the drawing sheet of FIG. 9). An alternate-current voltage applied to the heater 1 is AC 100 V, and the heater 1 generates heat with the applied voltage. The thermistor 5 configured to detect the temperature of the heater 1 is arranged in the vicinity of a center portion of the heater 1 in the longitudinal direction. At the time of image formation, the CPU 301 performs a control for supply of power to the heater 1 so that a detected temperature by the thermistor 5 reaches a predetermined target temperature. When the recording material P bearing the unfixed toner image T is introduced to the fixing nip portion formed between the fixing film 6 and the pressure roller 9, the recording material P is conveyed while being heated by the heater 1 and receiving the pressure from the pressure roller 9. With this, the unfixed toner image T is fixed to the recording material P.

(Fixing Temperature Adjustment Control During Print Preparation Operation)

Figure 10A:
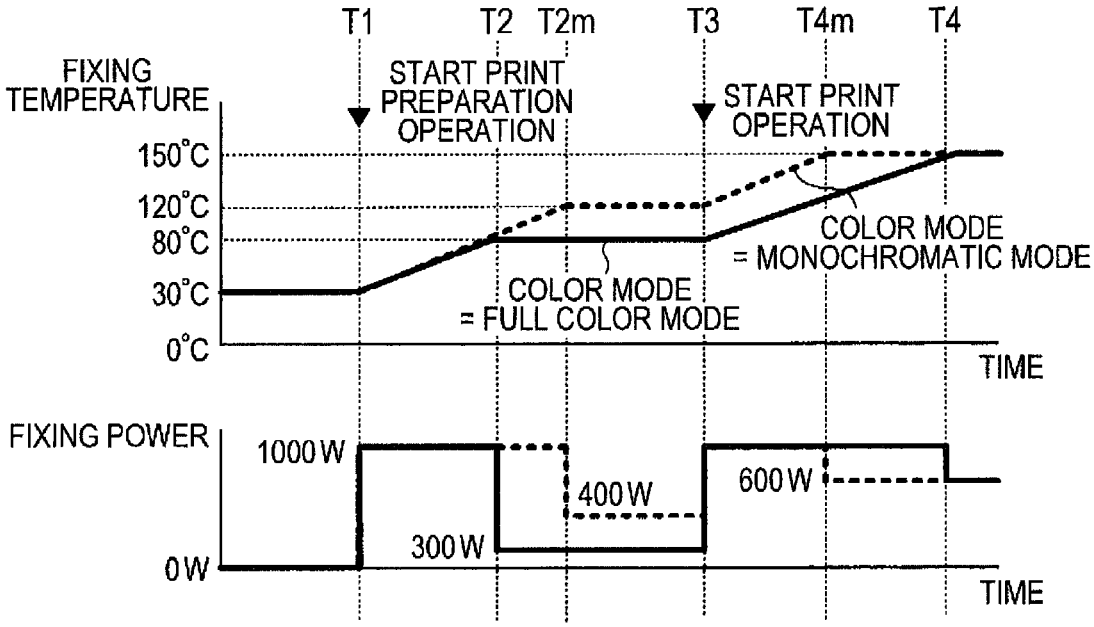
FIG. 10A is a graph for showing changes in temperature of a heater and a timing chart for illustrating states of supply of power to the heater.
Figures 10B, 10C, 10D:
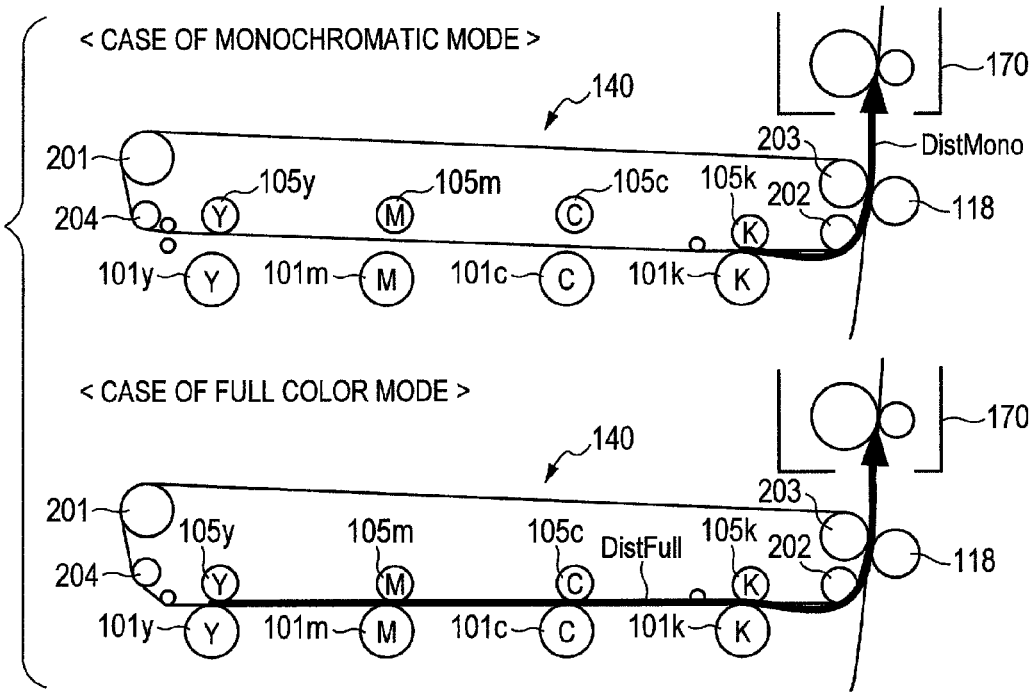
FIG. 10B is a table for showing print preparation temperatures and a print temperature.
FIG. 10C is a table for showing a relationship between a temperature difference between the print preparation temperature and a detected temperature, and time required to reach the print preparation temperature.
FIG. 10D is a sectional view of the vicinity of a secondary transfer portion.

A temperature adjustment control for the fixing device 170 during the print preparation operation is described with reference to FIG. 10A to FIG. 10D. FIG. 10A is a timing chart for illustrating a relationship between detected temperatures by the thermistor 5 and supply of power to the heater 1 at the start of the print preparation operation and at the start of the print operation in the fixing device 170. FIG. 10B is a table for showing print preparation temperatures, which are target temperatures during the print preparation operation, and a print temperature, which is a target temperature during the print operation, in a case where the full color mode or the monochromatic mode is designated as the color mode. In this embodiment, the temperature of the fixing device 170 is set to optimum target temperatures during the print preparation operation and the print operation in accordance with the color mode set by input through the operation unit 330. In FIG. 10B, the print preparation temperature, which is the target temperature during the print preparation operation, is 80° C. being a first temperature in the case where the full color mode is set as the color mode, and the print preparation temperature is 120° C. being a second temperature in the case where the monochromatic mode is set. The print temperature, which is the target temperature in the case of starting the print operation, is 150° C. being a third temperature in the case where the color mode is any one of the full color mode or the monochromatic mode.

With reference to FIG. 10A, the temperature adjustment for the fixing device 170 during the print preparation operation and the print operation is described. FIG. 10A is a graph (upper graph) for showing changes in temperature of the heater 1 of the fixing device 170 and a timing chart (lower timing chart) for illustrating states of supply of power to the heater 1, during the print preparation operation and the print operation. In the upper graph, the horizontal axis represents time, and the vertical axis represents the temperature of the heater 1 (fixing temperature in FIG. 10A). In the lower timing chart, the horizontal axis represents time, and the vertical axis represents power (fixing power in FIG. 10A) supplied to the heater 1. In FIG. 10A, the times T1, T2, T2*m*, T3, T4*m*, and T4 represent timings. The time T1 represents a timing of starting the print preparation operation. The time T3 represents a timing of starting the print operation. In FIG. 10A, the thick solid lines represent the state in which the color mode is the full color mode, and the broken lines represent the state in which the color mode is the monochromatic mode.

Description is made of the temperature adjustment for the fixing device 170 in the case where the color mode set through the operation unit 330 is the full color mode. At the time T1 of starting the print preparation operation, the CPU 301 performs supply of power of 1,000 W to the heater 1 until the detected temperature of the heater 1 by the thermistor 5 reaches 80° C. being the print preparation temperature in the case of the full color mode. Then, at the time T2, when the detected temperature by the thermistor 5 becomes equal to or higher than 80° C. being the print preparation temperature, the CPU 301 switches the supply of power to the heater 1 from 1,000 W to 300 W so that the detected temperature by the thermistor 5 is maintained at 80° C. being the print preparation temperature. The time T2 at which the detected temperature by the thermistor 5 becomes equal to or higher than 80° C. being the print preparation temperature is changed in accordance with the detected temperature by the thermistor 5 at the time T1.

FIG. 10C is a table for showing a relationship of a temperature difference, which is between the print preparation temperature and the detected temperature by the thermistor 5 at the time T1, with respect to time ta (=time T2−time T1) which is required to reach the print preparation temperature. For example, when the detected temperature by the thermistor 5 is 30° C. at the time T1, and in the case of the full color mode where the print preparation temperature is 80° C., the time ta required to raise the temperature by 50° C. (=80° C.−30° C.) to reach 80° C. is 8 seconds according to the value shown in the table. When the detected temperature by the thermistor 5 is 90° C. at the time T1, the temperature is already higher than 80° C. being the print preparation temperature for the case of the full color mode. Thus, the time ta is 0 seconds according to the value shown in the table. The data of the table shown in FIG. 10C is obtained in advance through experiment.

Next, from the time T3 of starting the print operation, the CPU 301 performs the supply of power of 1,000 W to the heater 1 until the detected temperature of the heater 1 by the thermistor 5 reaches 150° C. being the print temperature of fixing the unfixed toner image on the recording material P. At the time T4 at which the detected temperature by the thermistor 5 reaches 150° C. being the print temperature, and the recording material P having the unfixed toner image formed thereon arrives at the fixing device 170, the CPU 301 switches the supply of power to the heater 1 from 1,000 W to 600 W. That is, the CPU 301 switches the supply of power to the heater 1 from 1,000 W to 600 W so that the detected temperature by the thermistor 5 is maintained at 150° C. being the print temperature, thereby fixing the unfixed toner image T on the recording material P.

Description is made of the temperature adjustment for the fixing device 170 in the case where the color mode is the monochromatic mode, or in the case where the color mode is an automatic determination mode of setting the full color mode or the monochromatic mode based on whether or not an image of an original read by the image sensor 233 is a monochromatic image (based on property of an image). From the time T1 of starting the print preparation operation, the CPU 301 performs supply of power of 1,000 W to the heater 1 until the detected temperature of the heater 1 by the thermistor 5 reaches 120° C. being the print preparation temperature for the case of the monochromatic mode. Then, at the time T2*m*, when the detected temperature by the thermistor 5 is equal to or higher than 120° C. being the print preparation temperature, the CPU 301 switches the supply of power to the heater 1 from 1,000 W to 400 W so that the detected temperature by the thermistor 5 is maintained at 120° C. being the print preparation temperature. The time T2*m* at which the detected temperature by the thermistor 5 becomes equal to or higher than 120° C. being the print preparation temperature is changed in accordance with the detected temperature by the thermistor 5 at the time t1.

Next, at the time T3 of starting the print operation, the CPU 301 performs supply of power of 1,000 W to the heater 1 until the detected temperature of the heater by the thermistor 5 reaches 150° C. being the print temperature of fixing the unfixed toner image on the recording material P. At the time T4*m* at which the detected temperature by the thermistor 5 reaches 150° C. being the print temperature and at which the recording material P having the unfixed toner image formed thereon arrives at the fixing device 170, the CPU 301 switches the supply of power to the heater 1 from 1,000 W to 600 W. That is, the CPU 301 switches the supply of power to the heater 1 from 1,000 W to 600 W so that the detected temperature by the thermistor 5 is maintained at 150° C. being the print temperature, thereby fixing the unfixed toner image T on the recording material P.

In order to fix the unfixed toner image T on the recording material P, the print preparation temperature is set so that the detected temperature of the heater 1 by the thermistor 5 becomes equal to or higher than 150° C. at the time T4 at which the recording material P arrives at the fixing device 170. As the print preparation temperature is set higher, the temperature of the heater 1 can reach 150° C. being the print temperature earlier after the start of the print operation. However, as the print preparation temperature is set higher, more power needs to be supplied to maintain the heater 1 at the print preparation temperature, which is not efficient in terms of power saving. Therefore, in this embodiment, in accordance with the color mode set through the operation unit 330, the setting of the print preparation temperature is different between the case where the color mode is the full color mode and the case where the color mode is the monochromatic mode. With this, the temperature of the fixing device 170 reaches 150° C. being the print temperature at the time T4 (or time T4*m*), thereby being capable of shortening the first copy output time, which is the time required to output a first copy, and achieving power saving.

Description is made of a difference in setting of the print preparation temperature between the case where the color mode is the full color mode and the case where the color mode is the monochromatic mode. FIG. 10D is a sectional view of the vicinity of the intermediate transfer belt unit 140 and the secondary transfer portion 118. The view on the upper side is a sectional view for illustrating the case where the monochromatic mode is set as the color mode. The view on the lower side is a sectional view for illustrating the case where the full color mode is set as the color mode. In the view on the upper side of FIG. 10D, a distance DistMono indicated by the thick solid line represents a distance required for the recording material P to proceed from when the image forming station 120*k* for black starts image formation to when the recording material P having a black toner image T transferred thereon reaches the fixing device 170. In the view on the lower side of FIG. 10D, a distance DistFull indicated by the thick solid line represents a distance required for the recording material P to proceed from when the image forming station 120*y* for yellow starts image formation to when the recording material P having a yellow toner image T transferred thereon reaches the fixing device 170. As is apparent from FIG. 10D, the two distances DistMono and DistFull satisfy a relationship of distance DistFull>distance DistMono. The speed of image formation is equal in the monochromatic printing and the full color printing. Thus, the distance relationship and a time relationship from the start of image formation to the arrival of the recording material P at the fixing device 170 are similar. That is, time TsFull required for the recording material P to reach the fixing device 170 in the full color mode and time TsMono required for the recording material P to reach the fixing device 170 in the monochromatic mode satisfy a relationship of time TsFull>time TsMono.

Therefore, a time period of supplying power to the heater 1 from the start of the image formation by the image forming unit 120 to the arrival of the recording material P at the fixing device 170 is longer in the full color mode than the monochromatic mode. The print temperature of the fixing device 170 is equal in the monochromatic mode and the full color mode. Therefore, the print preparation temperature being the temperature of the fixing device 170 at the time of starting the print operation can be set lower in the case of the full color mode than the case of the monochromatic mode. As compared to the case of not switching the print preparation temperature in accordance with the color mode, in this embodiment, the print preparation temperature can be set lower in the case where the color mode is the full color mode. With this, the supply of power for maintaining the print preparation temperature can be set smaller, thereby being effective in terms of power saving. The print preparation temperature and the supply of power are set to fixed values in this embodiment, but may be changed in accordance with, for example, an environmental temperature or a power supply voltage.

(Control for Abutment and Separation Mechanism During Print Preparation Operation)

Description is made of a control for the abutment and separation mechanism 400 during the print preparation operation. In this embodiment, the state of the abutment and separation mechanism 400 is switched during the print preparation operation in accordance with the color mode setting which is set through the operation unit 330. At this time, when the full color mode is set as the color mode, the print preparation operation is performed so as to bring the abutment and separation mechanism 400 into the state of the abutment mode. When the automatic determination mode (third mode) is set, the print preparation operation is performed so as to bring the abutment and separation mechanism 400 into the separation mode. In the automatic determination mode, any one of the full color mode and the monochromatic mode is automatically set as the color mode based on a property of an input image. When the automatic determination mode is set, the same print preparation operation as the monochromatic mode is performed. Such a configuration is employed because of the following reason. In the case of the automatic determination mode, the color mode is not determined until printing is started. Thus, it is necessary to perform the print preparation operation with prediction of the color mode. Accordingly, improvement in the first copy output time can be expected when the print preparation operation is performed in the monochromatic mode which is frequently used.

Comparative Embodiment (Control Sequence for Print Preparation Operation)

Now, a comparative embodiment is described with reference to FIG. 11. FIG. 11 is a flowchart for illustrating a control sequence for the print preparation operation, and the control sequence is executed by the CPU 301. The processing of FIG. 11 is started upon detection of a print prediction operation from which a subsequent print operation start instruction is predicted, that is, upon detection of the opening and closing operations of the original pressure plate or the placement of an original on the original table 152 through the original feeder control portion 480 or the image reader control portion 280, or upon detection of an operation to the operation unit 330. In the comparative embodiment, during the print restricted operation, the print preparation operation is not performed in the full color mode, and the print preparation operation in the monochromatic mode is performed.

In S1001, the CPU 301 resets and starts a timer 291 to monitor whether or not a print operation start instruction is given within a predetermined time period. The timer 291 adds a timer value every 1 millisecond (ms), and the CPU 301 refers to the timer value of the timer 291 to determine an elapsed time from the start of the timer 291 in S1001. In S1002, the CPU 301 reads the color mode setting stored in the RAM 303 to determine whether or not the set color mode is the full color mode. When it is determined that the set color mode is the full color mode, the CPU 301 proceeds the processing to S1003. When it is determined that the set color mode is not the full color mode, that is, the set color mode is the monochromatic mode or the automatic determination mode, the CPU 301 proceeds the processing to S1007.

In S1003, in order to determine whether or not the full color print restricted operation is necessary, the CPU 301 starts the processing of determining the necessity of the full color print restricted operation described with reference to FIG. 3. In S1004, the CPU 301 reads a result of the processing of S1003 from the RAM 303 to determine whether or not the full color print restricted operation is unnecessary. When it is determined that the full color print restricted operation is unnecessary, the CPU 301 proceeds the processing to S1005. When it is determined that the full color print restricted operation is necessary, the CPU 301 proceeds the processing to S1007.

In S1005, the CPU 301 sets the color mode of the print preparation operation to the full color mode. In S1006, the CPU 301 sets the print preparation temperature of the fixing device 170 to 80° C. being the print preparation temperature for the full color mode (print preparation temperature=full color print preparation temperature), performs supply of power to the heater 1 of the fixing device 170, and proceeds the processing to S1009.

In the case of NO in S1002, the color mode set through the operation unit 330 is the monochromatic mode or the automatic determination mode. Thus, in S1007, the CPU 301 sets the color mode for the print preparation operation to the monochromatic mode. Further, when the print restricted operation is to be performed (NO in S1004), the CPU 301 sets the color mode for the print preparation operation to the monochromatic mode irrespective of the color mode setting which is set through the operation unit 330. In S1008, the CPU 301 sets the print preparation temperature of the fixing device 170 to 120° C. being the print preparation temperature for the monochromatic mode (print preparation temperature=monochromatic print preparation temperature), performs supply of power to the heater 1 of the fixing device 170, and proceeds the processing to S1009.

In S1009, the CPU 301 performs the control for the abutment and separation mechanism 400 in accordance with the color mode setting for the print preparation operation. The control for the abutment and separation mechanism 400 is executed in the subroutine, and details thereof are described later.

In S1010, the CPU 301 determines whether or not the print operation start instruction from the operation unit 330 is detected (in FIG. 11, "PRINT OPERATION START INSTRUCTION IS GIVEN"). When it is determined that the print operation start instruction is detected, the CPU 301 terminates the processing. When it is determined that the print operation start instruction is not detected, the CPU 301 proceeds the processing to S1013.

In S1013, the CPU 301 refers to the timer value of the timer 291 to determine whether or not 15 seconds or more have elapsed. When it is determined that 15 seconds or more have elapsed, the CPU 301 proceeds the processing to S1014. When the elapsed time is less than 15 seconds, the CPU 301 proceeds the processing to S1016. The time of 15 seconds is an example of a waiting time from the print prediction operation, from which the print operation start instruction is predicted, to detection of the print operation start instruction, and the time is not limited to 15 seconds. In S1014, the CPU 301 stops the supply of power to the heater 1 of the fixing device 170. In S1015, the CPU 301 controls the abutment and separation mechanism 400 to the state of the separation mode, and terminates the processing.

In S1016, the CPU 301 determines whether or not an operation of pressing a key or other operation is performed to the operation unit 330. When the operation is performed, the CPU 301 returns the processing to S1001. When the operation is not performed, the CPU 301 returns the processing to S1010.

When the print operation start instruction is detected, the CPU 301 terminates the print preparation operation and starts the print operation. Before the print operation is started, the CPU 301 checks whether or not the state of the abutment and separation mechanism 400 matches with the color mode setting given at the time of the print start instruction. Then, when the state is unmatched with the color mode setting, the CPU 301 performs the control to achieve the state in which the abutment and separation mechanism 400 matches with the color mode. Such a configuration is employed because of the following reason. In the case of the automatic determination mode, the abutment and separation mechanism 400 is in the state of separation to perform the print preparation operation in the monochromatic mode. Thus, when a print job of the full color mode is executed, the full color print operation cannot be performed in such a state.

Figure 4C:
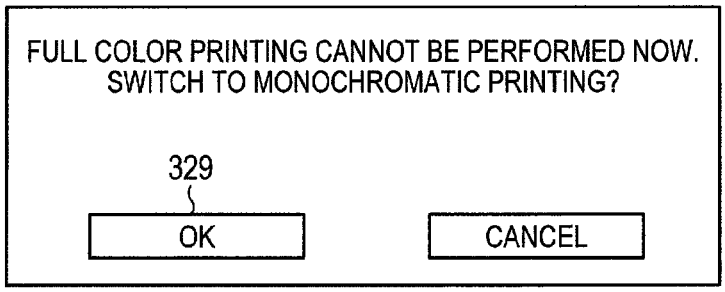
FIG. 4C is an illustration of a display portion of the operation unit.

In the comparative embodiment, when the print start instruction of the full color mode is received during the print restricted operation, the following processing is performed to notify that the full color printing cannot be performed. That is, the CPU 301 controls the display portion 311 (notification unit) of the operation unit 330 to display a message to confirm whether or not to perform the monochromatic printing (see FIG. 4C). Then, the CPU 301 performs the monochromatic printing when a user presses the OK button 329. The print preparation operation in the monochromatic mode is completed in advance. Thus, when the user presses the OK button 329, the CPU 301 switches, at the time of starting printing, the temperature of the fixing device 170 to 150° C. being the print temperature, and starts the image forming operation.

(Control Sequence for Abutment and Separation Mechanism)

Figure 12:
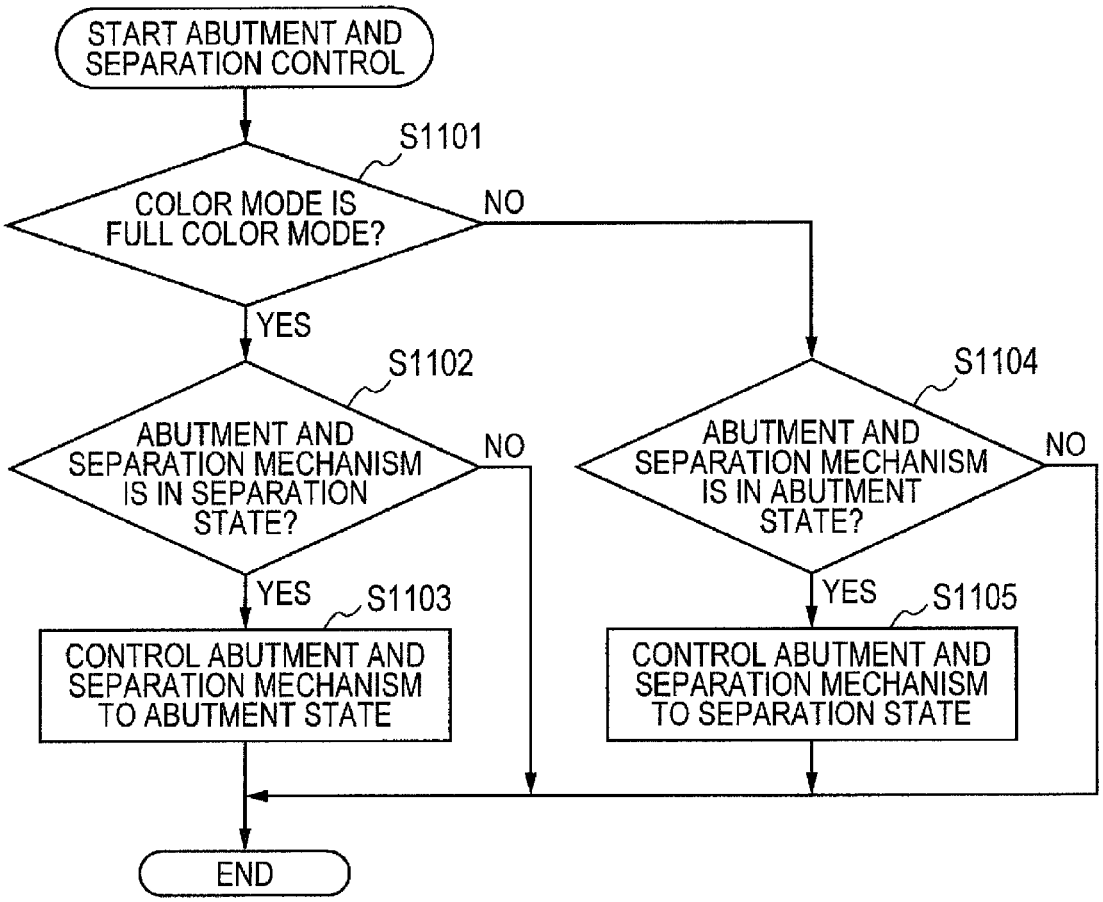
FIG. 12 is a flowchart of a control operation for the abutment and separation mechanism.

FIG. 12 is a flowchart for illustrating the subroutine of the control sequence for the abutment and separation mechanism 400. The subroutine is started when the processing of S1009 of FIG. 11 is executed, and the processing is executed by the CPU 301. When the processing is terminated, the CPU 301 proceeds to the processing of S1010 of FIG. 11.

In S1101, the CPU 301 reads the color mode setting for the print preparation operation to determine whether or not the set color mode is the full color mode. When it is determined that the set color mode is the full color mode, the CPU 301 proceeds the processing to S1102. When it is determined that the set color mode is not the full color mode, that is, the set color mode is the monochromatic mode, the CPU 301 proceeds the processing to S1104. In S1102, the CPU 301 determines whether or not the state of the abutment and separation mechanism 400 is the separation state (separation mode). When it is determined that the state of the abutment and separation mechanism 400 is the separation state, the CPU 301 proceeds the processing to S1103. When it is determined that the state of the abutment and separation mechanism 400 is not the separation state or is the abutment state, the CPU 301 terminates the processing without changing the state of the abutment and separation mechanism 400. In S1103, the CPU 301 shifts the state of the abutment and separation mechanism 400 to the abutment state (abutment mode), and terminates the processing.

In S1104, the CPU 301 determines whether or not the state of the abutment and separation mechanism 400 is the abutment state (abutment mode). When it is determined that the state of the abutment and separation mechanism 400 is the abutment state, the CPU 301 proceeds the processing to S1105. When it is determined that the state of the abutment and separation mechanism 400 is not the abutment state or is the separation state, the CPU 301 terminates the processing without changing the state of the abutment and separation mechanism 400. In S1105, the CPU 301 shifts the state of the abutment and separation mechanism 400 to the separation state (separation mode), and terminates the processing.

In the comparative embodiment, the print preparation operation control is switched in accordance with the color mode setting, thereby being capable of shortening the first copy output time. Further, when the color toner is used up, or during the print restricted operation in which only the monochromatic print operation can be performed due to a failure in a component which is used only for the full color print operation, the full color print preparation operation control is not performed, and the monochromatic print preparation operation is performed. With this, the print preparation operation can optimally be performed. As a result, an unnecessary operation is not performed during the print preparation operation, thereby being capable of achieving power saving for drive power. Further, the abrasion of the photosensitive drum due to the friction with the intermediate transfer belt is prevented, thereby being capable of extending the lifetime limit of the photosensitive drum.

Present Embodiment

In the comparative embodiment, the print preparation operation in the monochromatic mode is performed during the print restricted operation. However, in the case of the comparative embodiment, when only a scanning operation is performed under a state in which a user sets the color mode to the full color mode through the operation unit 330 during the print restricted operation, an unnecessary print preparation operation is performed. In order to avoid such a circumstance, in this embodiment, the print preparation operation is not performed during the print restricted operation when the instruction of the print preparation operation in the full color mode is received.

(Control Sequence for Print Preparation Operation)

FIG. 13 is a flowchart for illustrating a control sequence for the print preparation operation in the image forming apparatus according to this embodiment, and the control sequence is executed by the CPU 301. The processing of FIG. 13 is started upon detection of a print prediction operation from which a subsequent print operation start instruction is predicted, that is, upon detection of the opening and closing operations of the original pressure plate or the placement of an original on the original table 152 through the original feeder control portion 480 or the image reader control portion 280, or upon detection of an operation to the operation unit 330. The processing of FIG. 13 is different from the processing of the comparative embodiment illustrated in FIG. 11 in that the print preparation operation is not performed during the print restricted operation.

In FIG. 13, the processing steps of S1301 to S1308 are the same as the processing steps of S1001 to S1008 of the comparative embodiment of FIG. 11, except for the processing in the case of NO in S1304. Thus, description thereof is omitted. In S1304, the CPU 301 determines whether or not the full color print restricted operation is unnecessary. When it is determined that the full color print restricted operation is unnecessary, the CPU 301 proceeds the processing to S1305. When it is determined that the full color print restricted operation is necessary, the CPU 301 proceeds the processing to S1310.

In S1309, the CPU 301 performs the following processing to indicate that the print preparation operation in the full color mode (S1305 and S1306) or the print preparation operation in the monochromatic mode (S1307 and S1308) is performed. That is, the CPU 301 turns on a print preparation operation performance flag (hereinafter referred to as "performance flag"), stores the performance flag in the RAM 303, and proceeds the processing to S1311. Meanwhile, in S1310, in order to indicate that the print preparation operation is not performed, the CPU 301 turns off the performance flag, stores the performance flag in the RAM 303, and proceeds the processing to S1312.

The processing of S1311 is the same as the processing of S1009 of FIG. 11. Thus, description thereof is omitted. In S1312, the CPU 301 determines whether or not the print operation start instruction from the operation unit 330 is detected (in FIG. 13, "PRINT OPERATION START INSTRUCTION IS GIVEN"). When it is determined that the print operation start instruction is detected, the CPU 301 terminates the processing. When it is determined that the print operation start instruction is not detected, the CPU 301 proceeds the processing to S1313. In S1313, the CPU 301 reads the performance flag from the RAM 303 to determine whether or not the performance flag is in an on-state. When it is determined that the performance flag is in the on-state, the CPU 301 proceeds the processing to S1314. When it is determined that the performance flag is not in the on-state, or is in the off-state, the CPU 301 proceeds the processing to S1317. In S1314, the CPU 301 refers to the timer value of the timer 291 to determine whether or not 15 seconds or more have elapsed. When it is determined that the 15 seconds or more have elapsed, the CPU 301 proceeds the processing to S1315. When the elapsed time is less than 15 seconds, the CPU 301 proceeds the processing to S1317. The time of 15 seconds is an example of a waiting time from the print prediction operation, from which the print operation start instruction is predicted, to detection of the print operation start instruction, and the time is not limited to 15 seconds. The processing steps of S1315, S1316, and S1317 are the same as the processing steps of S1014, S1015, and S1016 of FIG. 11. Thus, description thereof is omitted.

When the print operation start instruction is detected, the CPU 301 terminates the print preparation operation. Also in this embodiment, similarly to the comparative embodiment, the CPU 301 checks, before starting the print operation, whether or not the state of the abutment and separation mechanism 400 matches with the color mode of the print start instruction, that is, the state of the abutment and separation mechanism 400 matches with the color mode set in the RAM 303. When the state of the abutment and separation mechanism 400 is unmatched with the color mode, the CPU 301 brings the abutment and separation mechanism 400 into the state of matching with the color mode setting. Such a configuration is employed because of the following reason. In the case of the automatic determination mode, the abutment and separation mechanism 400 is in the separation state to perform the print preparation operation in the monochromatic mode. Thus, when a print job of the full color mode is executed, the full color print operation cannot be performed in such a state.

In this embodiment, when the print start instruction of the full color is received during the print restricted operation under the state in which the color mode setting is set to the full color mode, neither the full color printing nor the monochromatic printing can be performed. Therefore, the CPU 301 controls the display portion 311 of the operation unit 330 to display a message to confirm whether or not to perform the monochromatic printing (see FIG. 4C). Then, when the user presses the OK button 329, in order to perform the monochromatic printing, the CPU 301 supplies power so that the temperature of the fixing device 170 reaches 150° C. being the print temperature at the time of starting printing, and thereafter starts the image forming operation.

In this case, the print preparation operation is not performed during the print restricted operation irrespective of the set color mode. Thus, the power is not supplied to the fixing device 170. Therefore, as compared to the comparative embodiment in which the print preparation operation in the monochromatic mode is performed in advance, the first copy output time becomes longer. When the scanning operation is performed under a state in which the user sets the color mode setting to the full color mode, the print preparation operation in the monochromatic mode is not performed in this embodiment, unlike the comparative embodiment. Therefore, the abrasion of the photosensitive drum 101*k* for black is prevented, thereby being capable of extending the lifetime limit of the photosensitive drum 101*k*.

In this embodiment, when the opening and closing of the original pressure plate, the placement of an original on the original table 152, or the operation to the operation unit 330 is detected, the CPU 301 performs the control for the print preparation operation. Operations from which printing is expected include, for example, a mounting and removing operation of the sheet feeding cassette 111, placement of a sheet on the multi tray 117, print condition setting input from the external computer 283 through the external I/F 282, or detection of an approach or a contact by a person through a human sensor. Therefore, those conditions may be added to the determination conditions in S1317 of FIG. 13, and the CPU 301 may perform the print preparation operation when those operations, from which printing is expected, are detected. In this embodiment, description is made of the control for the abutment and separation mechanism 400 and the control for the temperature adjustment of the fixing device 170 as subjects to the print preparation operation. For example, as the subject to the print preparation operation, the control for a startup operation for scanner motors (not shown), which are driven when the laser scanner units 103*y*, 103*m*, 103*c*, and 103*k* irradiate laser light to corresponding photosensitive drums 101, may be performed. In this case, when the print preparation operation is performed during the print restricted operation, the startup operation is performed only for the scanner motor of the laser scanner unit 103*k*, and the startup operation is not performed for the scanner motors of other laser scanner units 103*y*, 103*m*, and 103*c*.

As described above, according to this embodiment, the print preparation operation control can be performed in accordance with the state of the image forming unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-064112, filed Mar. 28, 2016, which is hereby incorporated by reference herein in its entirety.

What is claimed is:

1. An image forming apparatus, comprising:

an image forming unit including a plurality of image forming stations configured to respectively perform image formation of different colors, the image forming unit being configured to perform image formation on a recording sheet in any one of a first mode, in which image formation is performed through use of the plurality of image forming stations, and a second mode, in which image formation is performed through use of a predetermined image forming station among the plurality of image forming stations;

an operation unit configured to allow input of color mode information for setting whether the image forming unit is to perform image formation in the first mode or to perform image formation in the second mode; and a controller configured to:

i) control the image forming unit to perform a preparation operation for image formation in accordance with the color mode information before image formation when detecting an operation from which a start instruction of image formation is predicted;

ii) set a restricted operation state in which the controller prohibits performing the image formation in the first mode and permits performing the image formation in the second mode when any one image forming station, except for the predetermined image forming station, among the plurality of image forming stations is incapable of performing image formation, and the predetermined image forming station is capable of performing image formation; and iii) prevent the image forming unit from performing the preparation operation when the input color mode information sets to perform the image formation in the first mode, and the restricted operation state is set.

2. An image forming apparatus according to claim 1, wherein, the controller terminates the preparation operation if the start instruction is not input within a predetermined time period after the preparation operation is started.

3. An image forming apparatus according to claim 2, further comprising an input unit configured to input an image to be formed, wherein the color mode information includes first instruction information for instructing the image forming unit to perform the image formation in the first mode, second instruction information for instructing the image forming unit to perform the image formation in the second mode, and third instruction information different from the first instruction information and the second instruction information, and wherein, when the third instruction information is set as the color mode information, the controller determines to perform the image formation in the first mode or the second mode based on a property of the input image.

4. An image forming apparatus according to claim 3, wherein, when the image forming apparatus is in the restricted operation state, the first instruction information or the third instruction information is capable of selectively being set as the color mode information, and the second instruction information is incapable of being set as the color mode information.

5. An image forming apparatus according to claim 3, wherein the input unit includes a reader configured to read an image of an original, and wherein the operation from which the start instruction is predicted includes an operation of placing the original on a tray of the reader.

6. An image forming apparatus according to claim 5, wherein the reader includes a detector configured to detect a presence or absence of the original on the tray, and wherein the controller detects placement of the original on the tray based on a detection result of the detector.

7. An image forming apparatus according to claim 3, wherein the operation from which the start instruction is predicted includes an operation of inputting the color mode information through the operation unit.

8. An image forming apparatus according to claim 3, wherein each of the plurality of image forming stations includes a photosensitive member on which a toner image is formed, and an exposure unit configured to expose the photosensitive member, wherein the exposure unit includes a rotary polygon mirror configured to deflect laser light from a light source to expose the photosensitive member, and a motor configured to rotate the rotary polygon mirror, wherein, when the first instruction information is set as the color mode information, the controller causes the rotary polygon mirrors of all of the plurality of image forming stations to rotate as the preparation operation, and wherein, when the second instruction information or the third instruction information is set as the color mode information, the controller causes the rotary polygon mirror of the predetermined image forming station to rotate as the preparation operation, and prevents the rotary polygon mirrors of other image forming stations, except for the predetermined image forming station, among the plurality of image forming stations from rotating.

9. An image forming apparatus according to claim 8, wherein the restricted operation state includes a state in which the rotary polygon mirrors of the other image forming stations, except for the predetermined image forming station, among the plurality of image forming stations are not rotatable.

10. An image forming apparatus according to claim 3, wherein each of the plurality of image forming stations includes a photosensitive member on which a toner image is formed, wherein the image forming unit includes:

an intermediate transfer belt onto which toner images formed on the photosensitive members of the plurality of image forming stations are transferred; and a switching unit configured to switch abutment and separation between the photosensitive members of the plurality of image forming stations and the intermediate transfer belt, wherein, when the first instruction information is set as the color mode information, the controller controls the switching unit as the preparation operation so that the photosensitive members in all of the plurality of image forming stations are brought into an abutment state against the intermediate transfer belt, and wherein, when the second instruction information or the third instruction information is set as the color mode information, the controller controls the switching unit as the preparation operation so that the photosensitive member of the predetermined image forming station is brought into an abutment state against the intermediate transfer belt, and that the photosensitive members of other image forming stations, except for the predetermined image forming station, among the plurality of image forming stations are brought into a separation state from the intermediate transfer belt.

11. An image forming apparatus according to claim 3, further comprising:

a fixing unit configured to heat and fix an image formed on a recording material by the image forming unit; and a temperature detector configured to detect a temperature of the fixing unit, wherein, when the first instruction information is set as the color mode information, the controller controls the fixing unit as the preparation operation so that a temperature detected by the temperature detector is set to a first temperature, and wherein, when the second instruction information or the third instruction information is set as the color mode information, the controller controls the fixing unit as the preparation operation so that the temperature detected by the temperature detector is set to a second temperature higher than the first temperature.

12. An image forming apparatus according to claim 11, wherein, when the start instruction is input, the controller controls the fixing unit to set the temperature detected by the temperature detector to a third temperature higher than the second temperature.

13. An image forming apparatus according to claim 1, further comprising a notification unit, wherein, when the image forming apparatus is in the restricted operation state and the start instruction is input, the controller controls the notification unit to notify that the image formation in the first mode is incapable of being performed.

14. An image forming apparatus according to claim 1, wherein each of the plurality of image forming stations includes a photosensitive member on which a toner image is to be formed, and wherein, when an amount of use of the photosensitive member of any one image forming station, except for the predetermined image forming station, among the plurality of image forming stations reaches a predetermined amount, the controller sets the restricted operation state.

15. An image forming apparatus according to claim 1, wherein each of the plurality of image forming stations includes a developing device storing toner for formation of a toner image, and wherein, when toner is used up in the developing device of any one image forming station, except for the predetermined image forming station, among the plurality of image forming stations, the controller sets the restricted operation state.

16. An image forming apparatus according to claim 1, wherein each of the plurality of image forming stations includes a photosensitive member on which a toner image is formed, and a drive unit configured to drive the photosensitive member, and wherein, when the drive unit of any one image forming station, except for the predetermined image forming station, among the plurality of image forming stations is incapable of driving the photosensitive member, the controller sets the restricted operation state.

* * * * *